US010132600B2

(12) United States Patent
Saunders et al.

(10) Patent No.: US 10,132,600 B2
(45) Date of Patent: Nov. 20, 2018

(54) TARGET ASSEMBLY WITH INTERCHANGEABLE TARGET BODIES

(71) Applicants: Charles A. Saunders, Columbus, NE (US); Brett A. Saunders, Omaha, NE (US)

(72) Inventors: Charles A. Saunders, Columbus, NE (US); Brett A. Saunders, Omaha, NE (US)

(73) Assignee: SAUNDERS ARCHERY COMPANY, Columbus, NE (US)

( * ) Notice: Subject to any disclaimer, the term of this patent is extended or adjusted under 35 U.S.C. 154(b) by 0 days.

(21) Appl. No.: 14/216,287

(22) Filed: Mar. 17, 2014

(65) Prior Publication Data

US 2014/0265135 A1 Sep. 18, 2014

Related U.S. Application Data

(60) Provisional application No. 61/799,240, filed on Mar. 15, 2013.

(51) Int. Cl.
*F41J 7/04* (2006.01)
*F41J 1/01* (2006.01)
(Continued)

(52) U.S. Cl.
CPC . *F41J 7/04* (2013.01); *F41J 1/01* (2013.01); *F41J 1/10* (2013.01); *F41J 3/0004* (2013.01); *F41J 13/02* (2013.01)

(58) Field of Classification Search
CPC ..... F41J 7/04; F41J 13/02
(Continued)

(56) References Cited

U.S. PATENT DOCUMENTS 675,804 A * 6/1901 Tyrell ..... 273/392
687,873 A * 12/1901 Daniels ..... F41J 7/04 273/390

(Continued)

FOREIGN PATENT DOCUMENTS

GB 2279137 A * 12/1994 ..... F41J 13/02

OTHER PUBLICATIONS

Champion Double Hanging Spinner, http://www.championtarget.com/targets/interactive/duraseal.aspx, captured Feb. 5, 2013.*

(Continued)

*Primary Examiner* — Melba Bumgarner
*Assistant Examiner* — Laura L Davison
(74) *Attorney, Agent, or Firm* — Levenfeld Pearlstein, LLC

(57) ABSTRACT

A collapsible target is disclosed. The target comprises a frame that is collapsible from an open, unfolded configuration, to a closed, folded configuration. A fabric housing is mounted on the frame using a series of capped connectors and grommets. The housing comprises a plurality of panels joined together to from an inner compartment. The front panel of the compartment is formed with a window. A target assembly comprising a self-resetting spinner and a base is mounted in the compartment behind the window. The spinner may be mounted on an illuminated axle. The base is dimensioned for alternately holding a breakable clay target. The target is highly portable and easy to setup and take down. The target may be conveniently stored in a bag when not in use.

12 Claims, 55 Drawing Sheets

(51) Int. Cl.
*F41J 1/10* (2006.01)
*F41J 3/00* (2006.01)
*F41J 13/02* (2009.01)

(58) Field of Classification Search
USPC ..... 273/371, 390–392, 410
See application file for complete search history.

(56) References Cited

U.S. PATENT DOCUMENTS 1,435,768 A * 11/1922 Wang ..... 273/392
2,113,719 A * 4/1938 Creswell ..... F41J 7/04 273/386
2,397,921 A * 4/1946 Cole ..... 273/410
2,703,407 A * 3/1955 Henoch ..... A47K 13/24 248/205.5
3,795,353 A * 3/1974 Weiss ..... A44C 5/14 16/262
3,979,118 A 9/1976 Saunders et al.
4,093,227 A 6/1978 Saunders et al.
4,657,261 A 4/1987 Saunders
5,390,924 A * 2/1995 Antonious ..... A63B 53/04 473/328
5,397,267 A * 3/1995 Vecellio ..... B60H 1/3428 454/155
5,580,093 A * 12/1996 Conway ..... B60Q 1/326 280/816
5,810,363 A 9/1998 Saunders et al.
D411,387 S 6/1999 Zheng
5,975,626 A 11/1999 Aycock
D432,325 S 10/2000 Zheng et al.
D432,823 S 10/2000 Zheng
D433,244 S 11/2000 Zheng
D433,574 S 11/2000 Zheng
6,155,571 A * 12/2000 Reinertsen ..... 273/390
6,158,361 A 12/2000 Zheng et al.
6,231,119 B1 5/2001 Zheng
6,234,089 B1 5/2001 Zheng et al.
6,237,993 B1 5/2001 Zheng
6,241,311 B1 6/2001 Zheng
6,247,748 B1 6/2001 Zheng
6,296,304 B1 10/2001 Zheng
6,302,479 B1 10/2001 Zheng
6,364,411 B1 4/2002 Zheng
7,114,725 B2 * 10/2006 Camp ..... F41J 1/10 273/390
7,134,977 B2 * 11/2006 Campbell et al. ..... 473/454
7,690,656 B2 4/2010 Saunders
7,845,646 B1 * 12/2010 Weber ..... F41J 1/01 273/407
8,434,765 B1 * 5/2013 Taylor ..... F41J 9/165 273/362
8,807,570 B1 * 8/2014 Zalar ..... 273/390
2005/0200079 A1 * 9/2005 Barber ..... A63B 63/008 273/400
2006/0082067 A1 * 4/2006 Wong et al. ..... 273/410
2011/0024985 A1 * 2/2011 Potterfield et al. ..... 273/348
2014/0232067 A1 * 8/2014 Barry ..... 273/392

OTHER PUBLICATIONS

Champion Interlocking Spinner Target, http://www.championtarget.com/targets/interactive/duraseal.aspx, captured Jan. 4, 2013.*
Gamo Plinking Target, http://airgunbuyer.com/details.asp?cat=Accessories&SubCat=Targets%20Accessories&Product=2915, captured Nov. 9, 2012.*

* cited by examiner

TARGET ASSEMBLY WITH INTERCHANGEABLE TARGET BODIES

CROSS REFERENCE TO RELATED APPLICATIONS

This application claims benefit of U.S. Provisional Patent Application Ser. No. 61/799,240, filed on Mar. 15, 2013, the disclosure of which is incorporated herein by reference.

BACKGROUND OF THE INVENTION

The present invention relates generally to targets, and more particularly to a collapsible target that is portable and easy to setup and take down.

Target devices are well known in the art. Such devices often are used to practice marksmanship for recreational purposes and are also widely used in competitive marksmanship settings.

Numerous types and styles of targets have been developed, intended to be used with various types of projectiles, such as arrows, shot and bullets. The targets can be in the form of a relatively simple plastic sheet marked with a "bulls-eye" and secured to a backstop material, or can be relatively complex mechanical devices with cantilevered arms and sophisticated counterbalancing systems.

For example, in the field of archery alone, prior art targets run the gamut from simple 10-circle paper targets attached to a bag, tree or bale of hay, to block targets utilizing a friction foam design, to three-dimensional foam core targets formed in the shapes of animals.

Other types of targets are known, again particularly in the archery field. U.S. Pat. No. 5,810,363 for a "Target Assembly," (the disclosure of which is fully incorporated herein by reference) for example, discloses a target having a tensioned web material that absorbs the impact force of the projectile and automatically resets itself for the next projectile. U.S. Pat. No. 4,657,261 for a "Spring Mounted Silhouette Archery Target Apparatus" (the disclosure of which is fully incorporated herein by reference) discloses a structure configured to receivingly stop and hold an arrow while pivoting backwards to absorb some of the shock of the impact of the arrow. Finally, U.S. Pat. Nos. 4,093,227 and 3,979,118 (the disclosures of which are fully incorporated herein by reference) teach a target device having a pair of targets mounted at a generally right angle to one another with a shock absorber means disposed between the targets.

Outside of the archery field, numerous additional types of targets are known. For example, in the field of guns and air rifles, the prior art has developed paddles, typically comprised of steel, specifically configured to withstand the high velocity associated with projectiles fired from such devices. Known prior art targets in this field often use a spring mechanism to help absorb the high impact forces generated by such projectiles.

One prior art target that is capable of being used with multiple types of projectiles is disclosed in U.S. Pat. No. 7,690,656 for a "Self-Resetting Paddle Target" issued to Saunders, the disclosure of which is fully incorporated herein by reference. This target comprises a self-resetting paddle target. The target is comprised of at least one paddle mounted to a carrier body. The paddle may be flexible or rigid depending upon the speed of the projectile used with the target. The carrier body is rotatably mounted to a support rod such that the carrier body may freely rotate about the support rod with the paddle extending therefrom. The bottom surface of the carrier body is formed as a cam follower configured to engage the upper surface of a carrier support member that is fixedly fastened to the support rod and that acts as a cam.

The interaction of the carrier body (the cam follower) and the carrier support member (the cam) controls the rotation of the carrier body about the support rod and allows the paddle to reset itself after being impacted by a projectile. The paddle target further comprises a frame and a protective apron, the protective apron acting both to protect the target's mechanics from damage by projectiles and to provide a dampening effect to the paddle. A plurality of paddles may be disposed along the support rod.

Despite the numerous types of targets known in the prior art, the prior art has not developed a target that is highly portable and easy to setup and take down. Such a target could be easily stored (such as in a bag, much like a folding chair) and readily transported to events, parks and the like for use as a recreation device or in shooting competition, such as slingshot competitions. Because such a target would be simple and quick to setup and take down, it could be used spontaneously without the need to spend time assembling prior art targets. The collapsible target disclosed and claimed herein satisfies this need.

Desirably, the collapsible target disclosed and claimed herein includes a frame that is collapsible from an open, unfolded configuration, to a closed, folded configuration. More desirably, the collapsible target disclosed and claimed herein includes a fabric housing mounted on the frame that forms a compartment in which a target is mounted. More desirably still, the target comprises a self-resetting spinner mounted within a base. Even more desirably, the base is adaptable to hold the self-resetting spinner and, alternatively, a traditional breakable clay target. Most desirably, the self-resetting spinner may be mounted to the base using a glow stick or other illuminable member to allow the target to be used in low-light environments.

BRIEF SUMMARY OF THE INVENTION

The collapsible target disclosed herein includes a frame that is collapsible from an open, unfolded configuration, to a closed, folded configuration. The frame is of the type known in the prior art as a foldable chair frame, and comprises tubular members connected by joints. When in the open, unfolded configuration, the tubular members form front legs, rear legs, a horizontal mounting structure, and a vertical mounting structure. When in the closed, folded configuration, the frame converts to a compact, generally vertical structure that can be stored in a bag and readily transported and stored.

A fabric housing is mounted on the frame using a series of capped connectors and grommets. The fabric housing preferably is padded along its edges and preferably includes an apron covering the front legs of the frame. The fabric housing comprises a plurality of panels joined together to from an inner compartment having a generally right triangular cross-section, with one leg of the right triangle forming the front panel of the compartment, the other leg of the right triangle forming the bottom panel of the compartment, and the hypotenuse of the right triangle forming the rear panel of the compartment. Advantageously, the rear panel of the compartment is angled forwardly and downwardly such that projectiles hitting the rear panel are directed to the bottom of the compartment.

The front panel of the compartment is formed with a window covering substantially the entire area of the front panel. Mounted within the compartment behind the window is a target assembly, the assembly comprising a base and a self-resetting spinner rotatably mounted within the base. The spinner is mounted on a horizontal axle and is angled and weighted such that the front face of the spinner will always reset (the front of the spinner will face the front of the target) after being struck by a projectile.

In a disclosed embodiment, the spinner is formed with apertures along its width, the apertures being in general alignment with the axle. The axle may be a glowstick or other illuminable member such that the emitted light passes through the apertures to allow the target assembly to be seen in low-light environments.

The base is a generally circular member having a pair of receptacles for receiving and holding the axle and a plurality of posts for receiving the ends of mounting members used to position the target assembly within the compartment and generally centered within the window. In the disclosed embodiment, the mounting members comprise two lengths of flexible rubber tubing. The ends of each length of rubber tubing are mounted to the posts of the base. One length of rubber tubing is mounted between the lower half of the base and hooks disposed in the lower front corners of the compartment. The other length of rubber tubing is mounted between the upper half of the base and hooks disposed in the upper and lower back corners of the compartment.

In the disclosed embodiment a catch panel is mounted between the lengths of rubber tubing within the compartment. The catch panel may be angled forwardly such that projectiles entering the compartment and landing on the catch panel may roll to the front of the compartment for easy retrieval.

In addition to holding the spinner, the base is advantageously configured to hold traditional, breakable clay targets when the spinner is removed.

These and other features and advantages of the collapsible target disclosed and claimed herein will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
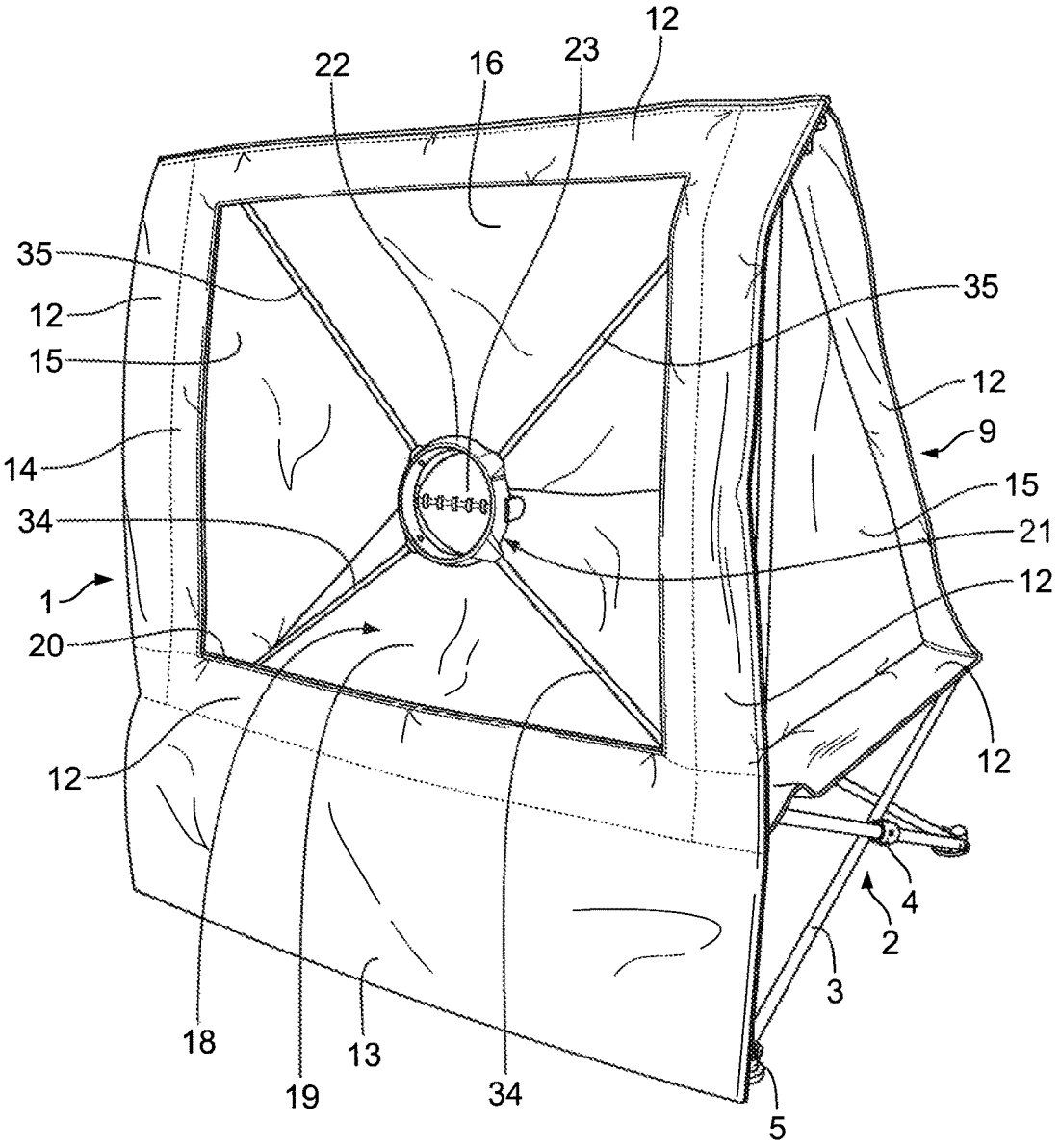
FIG. 1 is a perspective view of a collapsible target embodying the principles of the claimed device.
Figure 2:
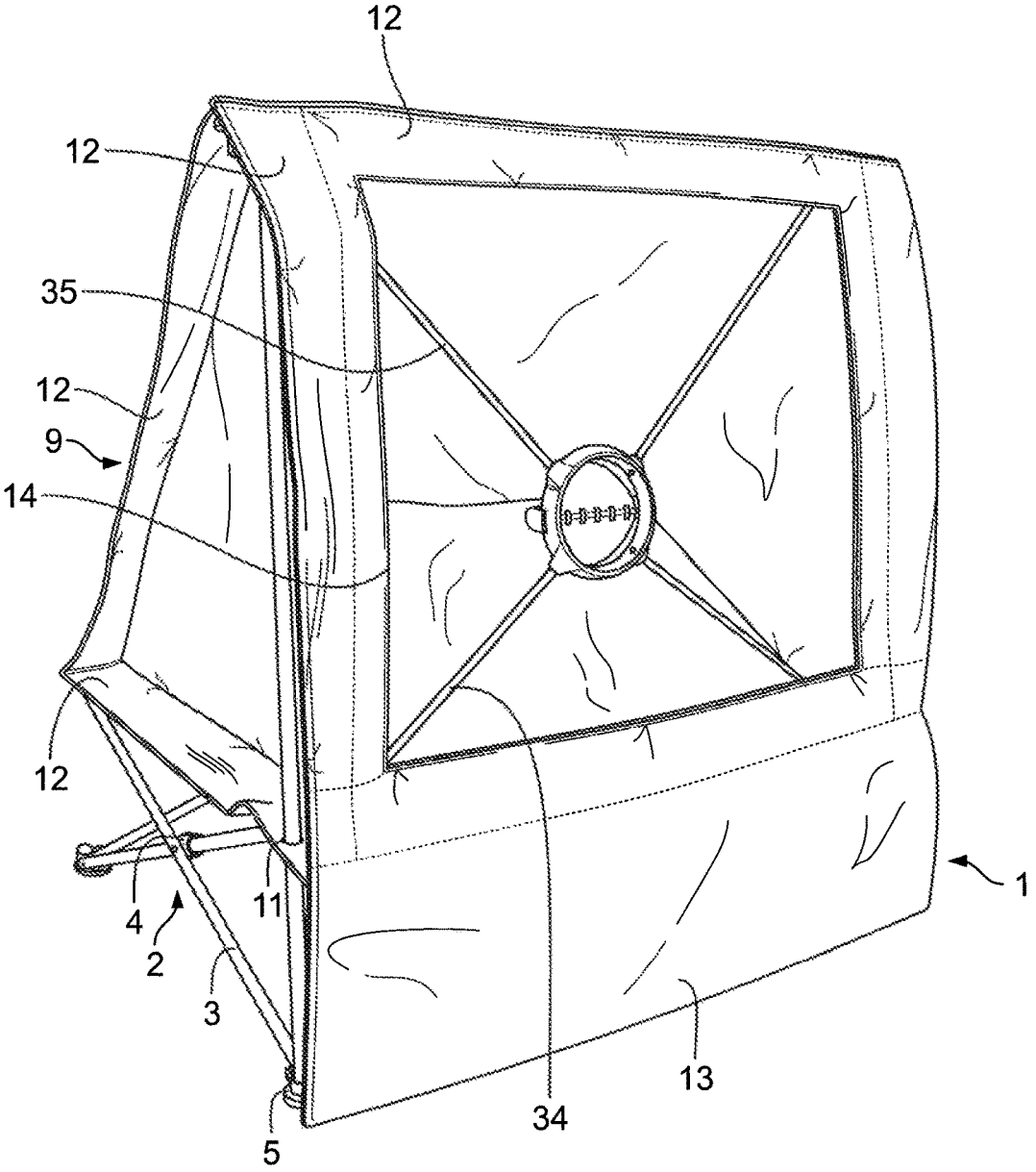
FIG. 2 is a perspective view of the collapsible target of FIG. 1.
Figure 3:
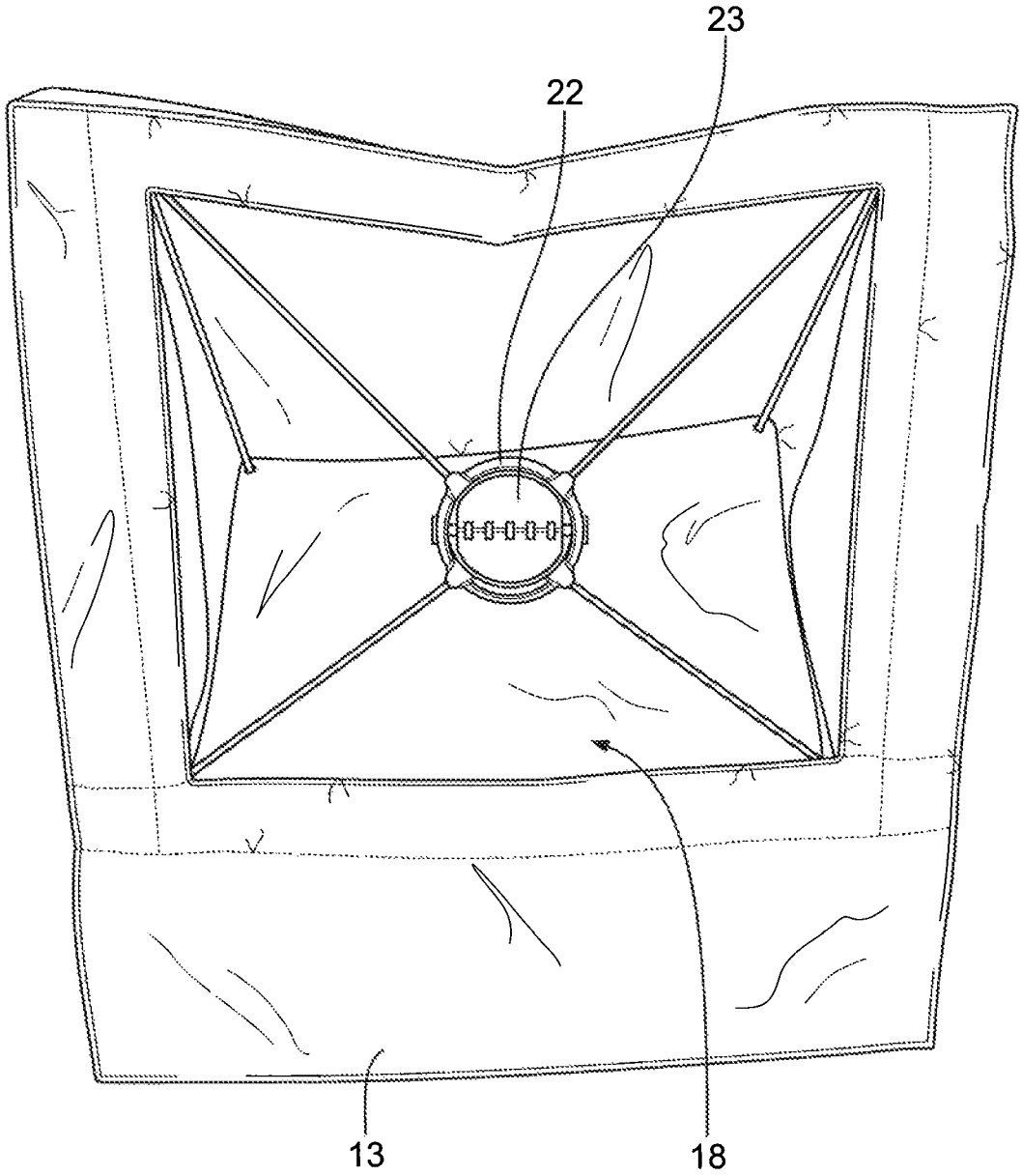
FIG. 3 is a front view of the collapsible target of FIG. 1.
Figure 4:
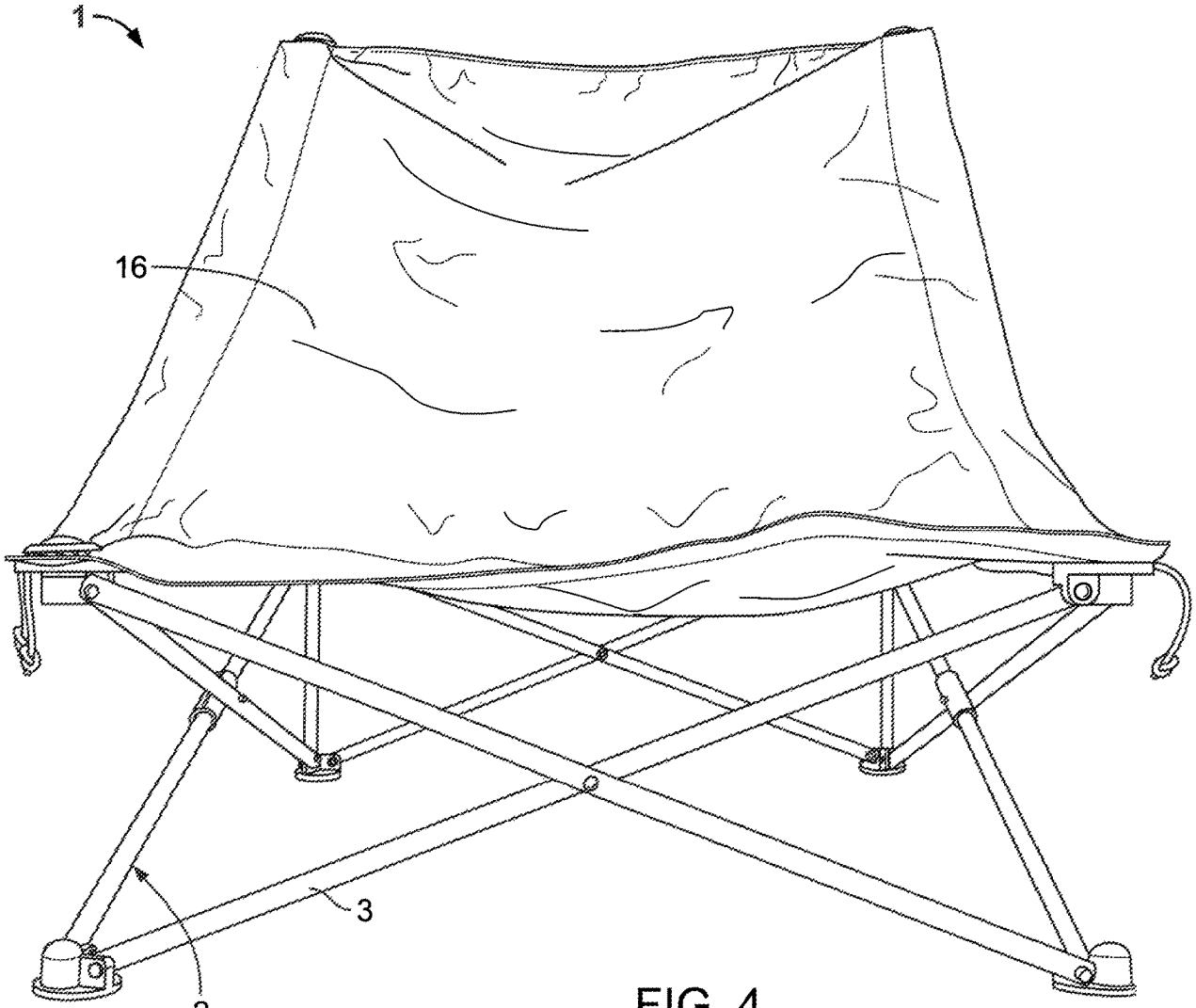
FIG. 4 is a rear view of the collapsible target of FIG. 1.
Figure 5:
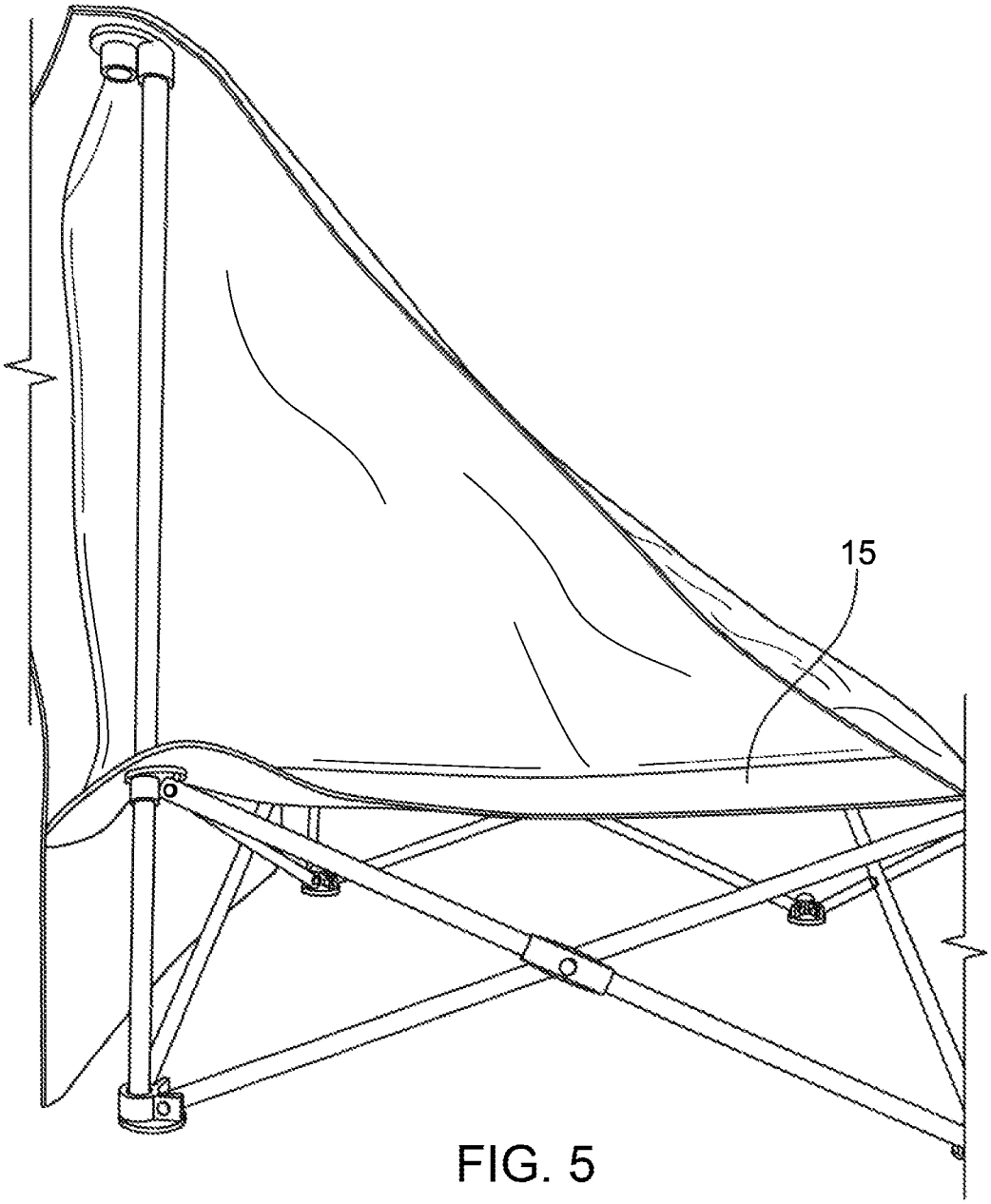
FIG. 5 is a right side view of the collapsible target of FIG. 1.
Figure 6:
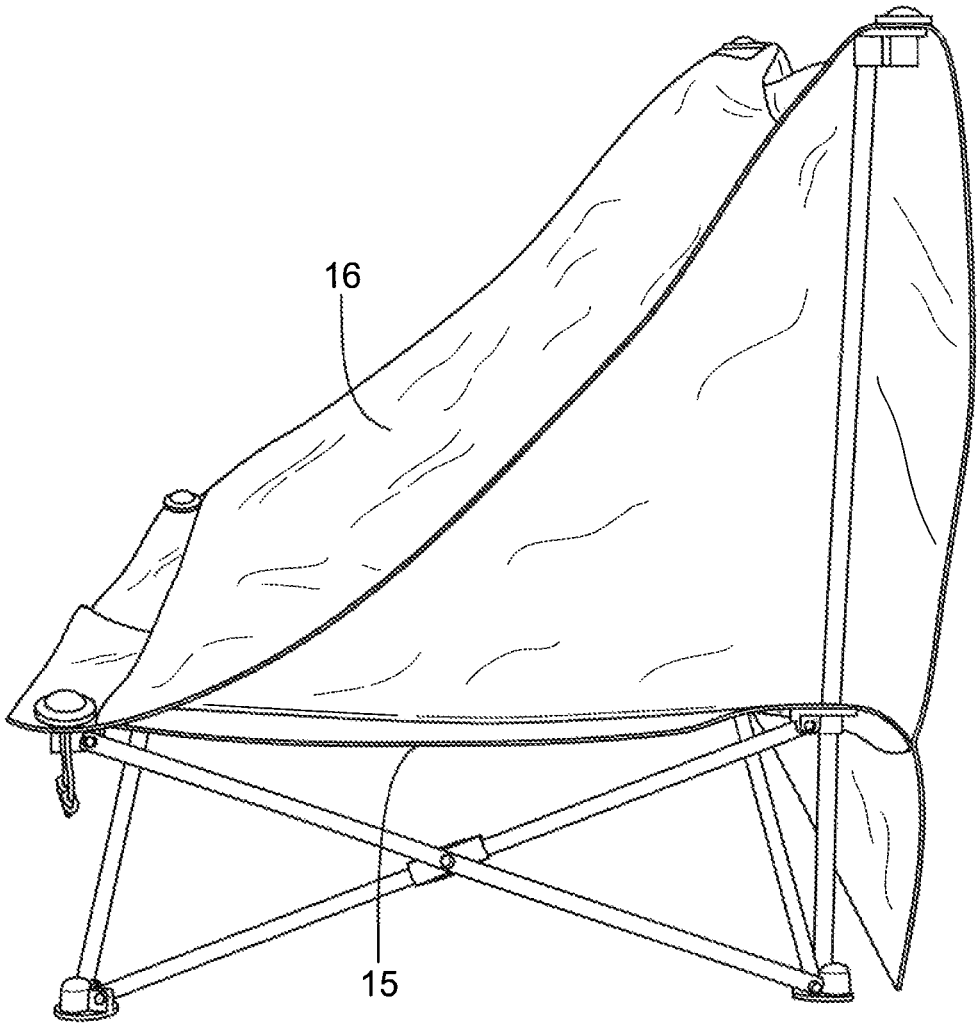
FIG. 6 is a left side view of the collapsible target of FIG. 1.
Figure 7:
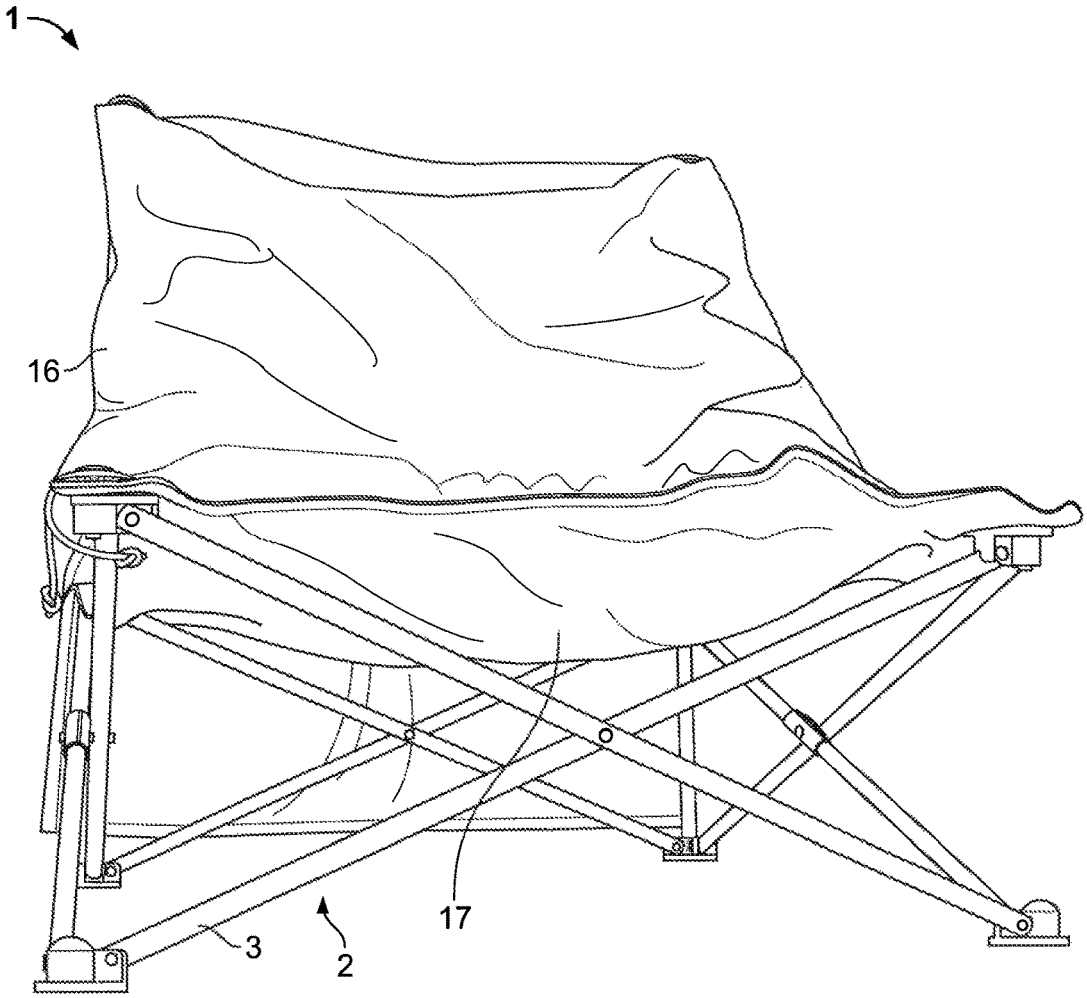
FIG. 7 is a rear view of the collapsible target of FIG. 1.
Figure 8:
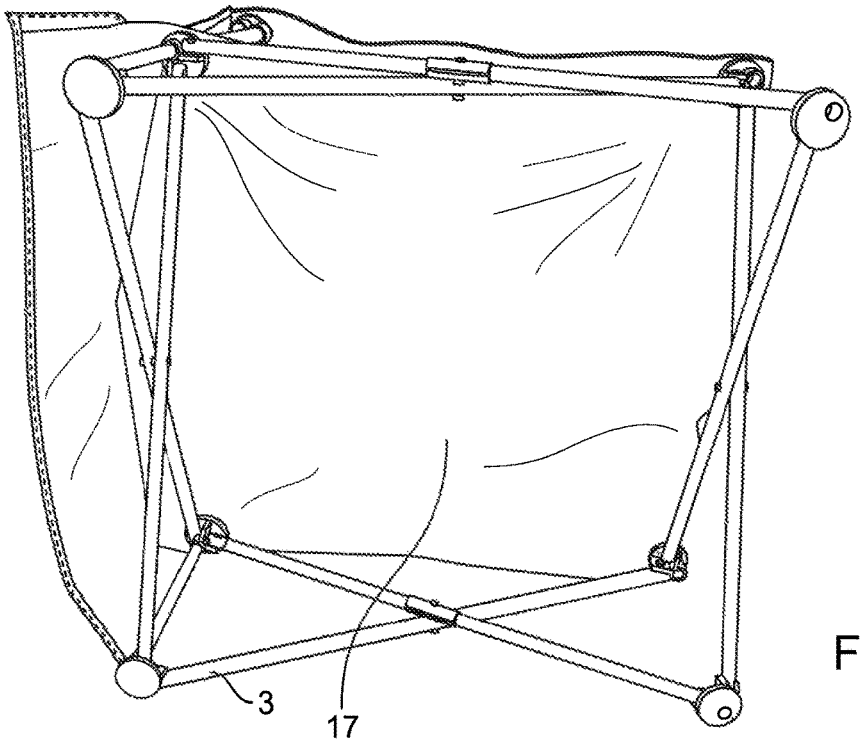
FIG. 8 is a bottom view of the collapsible target of FIG. 1.
Figure 9:
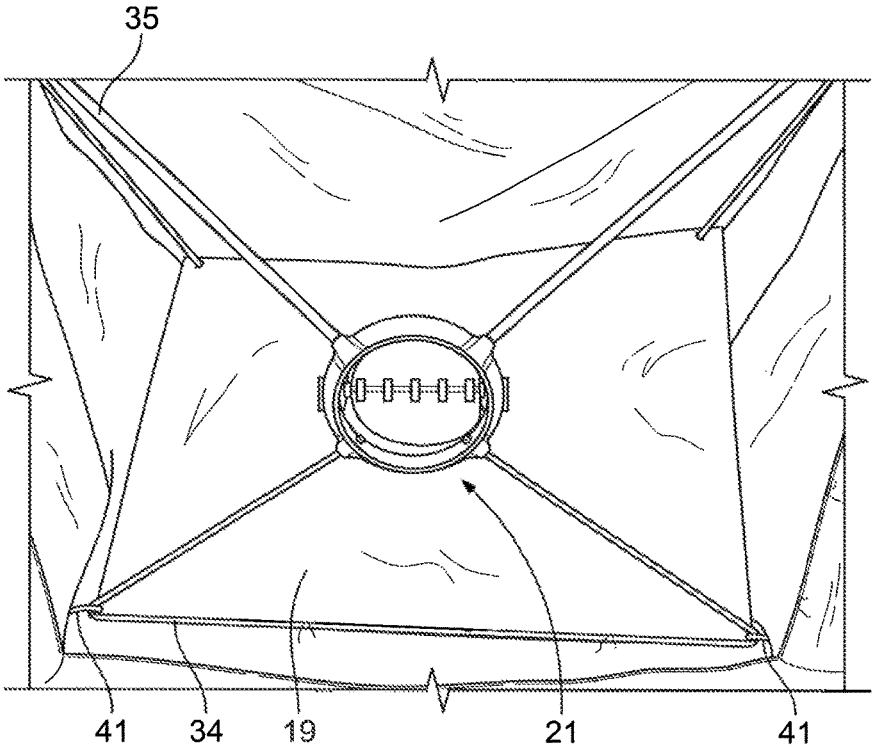
FIG. 9 is fragmentary front view of the collapsible target of FIG. 1.
Figure 10:
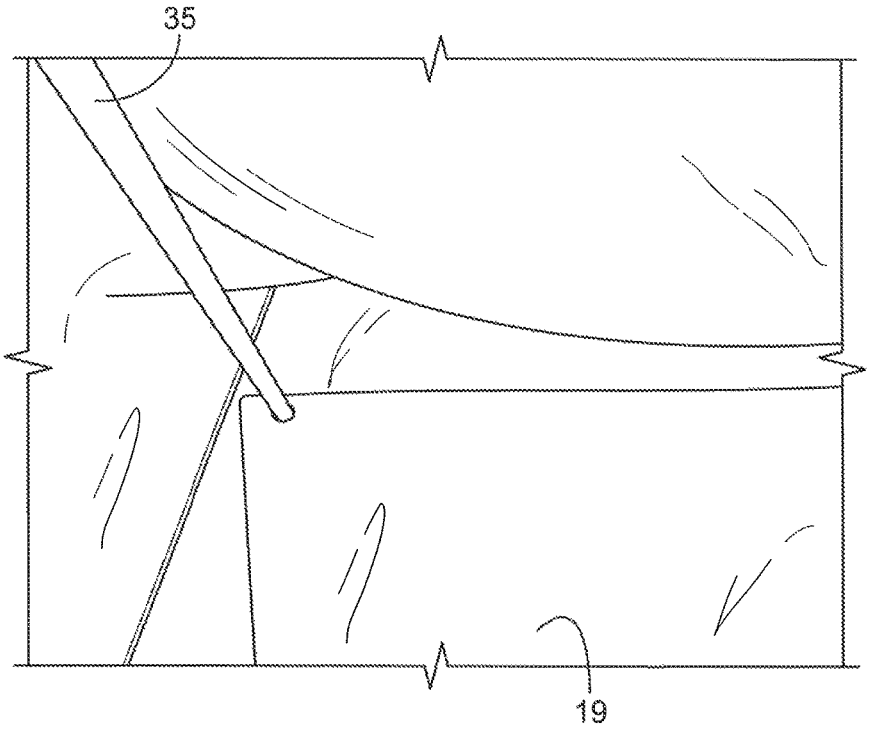
FIG. 10 is an enlarged fragmentary view of the interior of the compartment of the collapsible target of FIG. 1.
Figure 11:
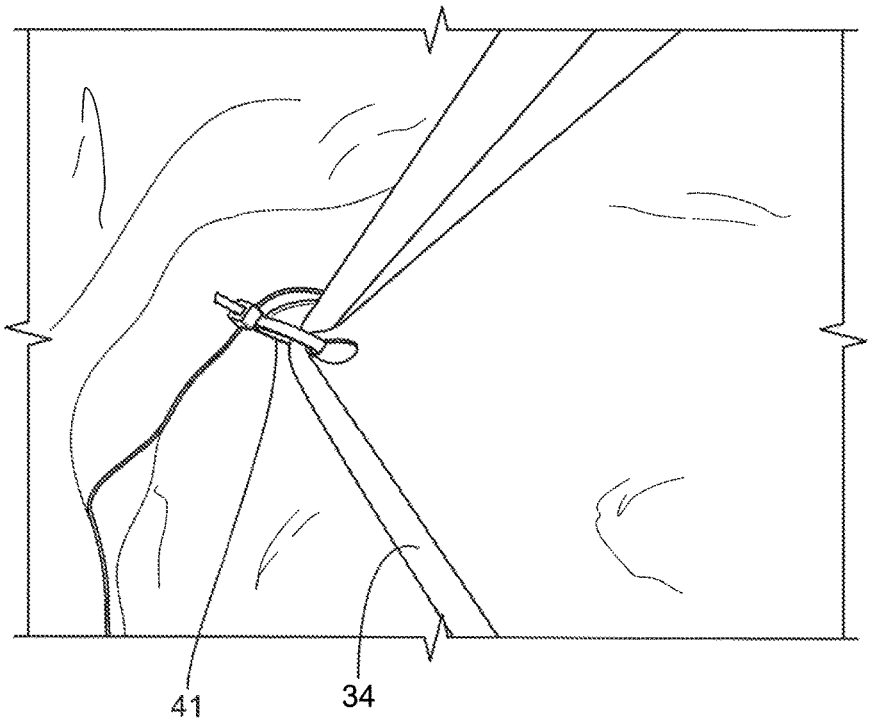
FIG. 11 is an enlarged fragmentary view of the interior of the compartment of the collapsible target of FIG. 1.
Figure 12:
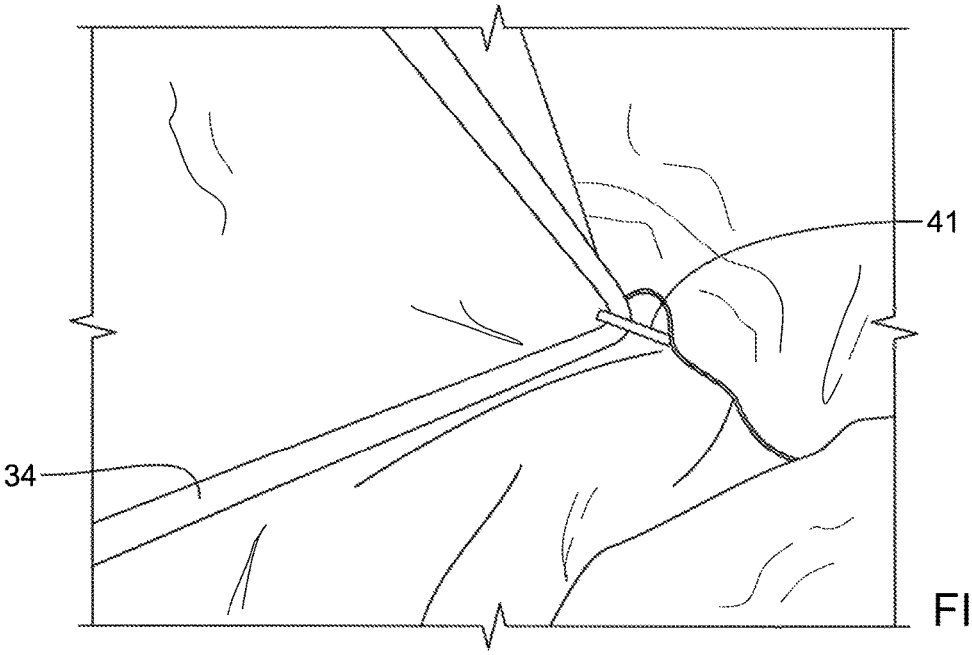
FIG. 12 is an enlarged fragmentary view of the interior of the compartment of the collapsible target of FIG. 1.
Figure 13:
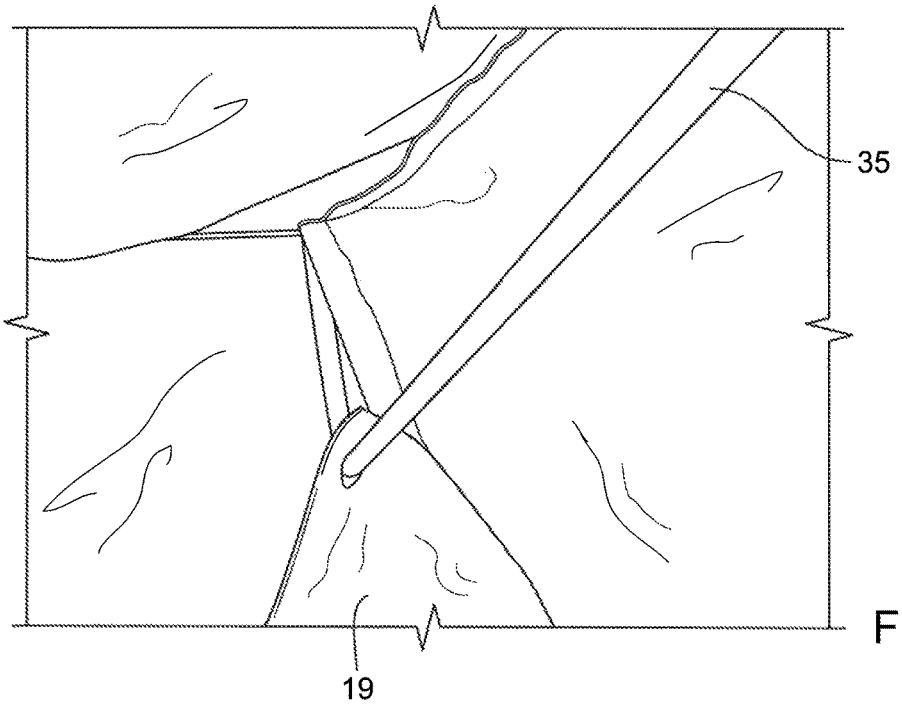
FIG. 13 is an enlarged fragmentary view of the interior of the compartment of the collapsible target of FIG. 1.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description of the Invention," relates to a requirement of the United States Patent Office, and does not imply, nor should be inferred to limit the subject matter disclosed herein.

FIGS. 1-36 illustrate a collapsible target 1 according to one embodiment. As shown in FIGS. 1-36, target 1 comprises a frame 2 that is collapsible from an open, unfolded configuration, to a closed, folded configuration. Frame 2 is known in the prior art as a foldable chair frame.

Once such prior art foldable chair frame is disclosed in U.S. Pat. No. 6,247,748 issued to Zheng for a "Seat Support Arrangement for Folding Chair," the disclosure of which is fully incorporated herein by reference. A prior art collapsible chair frame suitable for use as frame 2 for collapsible target 1 is manufactured by MacSports Inc. as part of its commercially available "Quad Chair" product.

Figure 14:
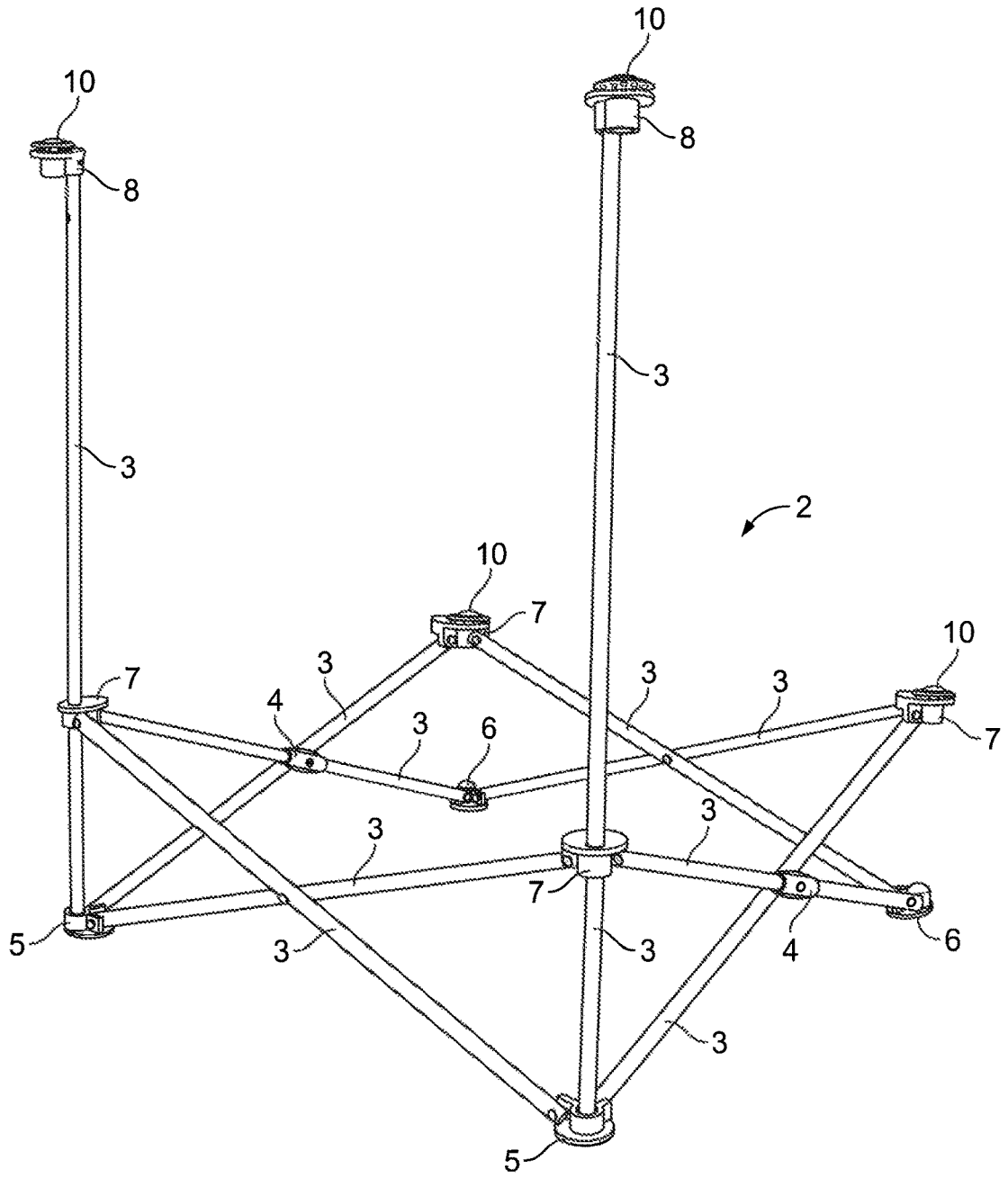
FIG. 14 is a perspective view of the frame of the collapsible target of FIG. 1.
Figure 15:
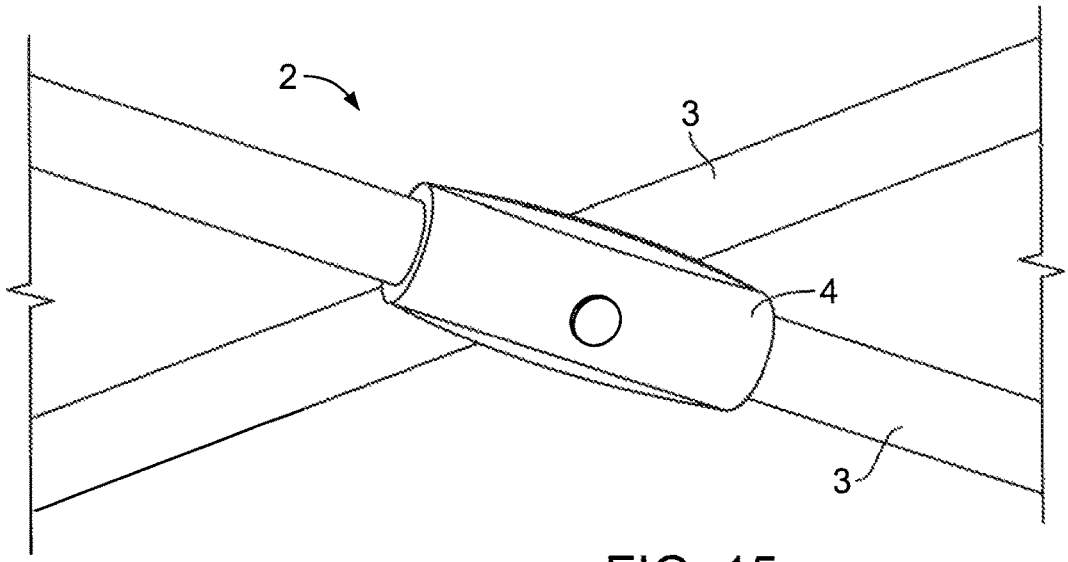
FIG. 15 is an enlarged side view of a joint of the frame of the collapsible target of FIG. 1.
Figure 16:
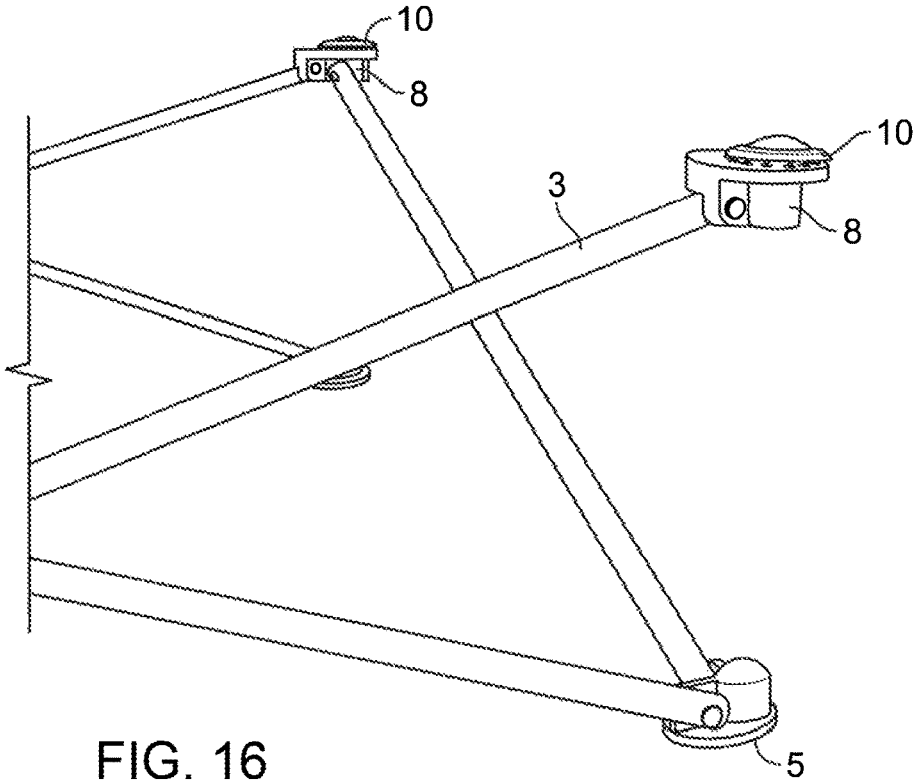
FIG. 16 is a perspective view of a capped connector of the frame of the collapsible target of FIG. 1.
Figure 17:
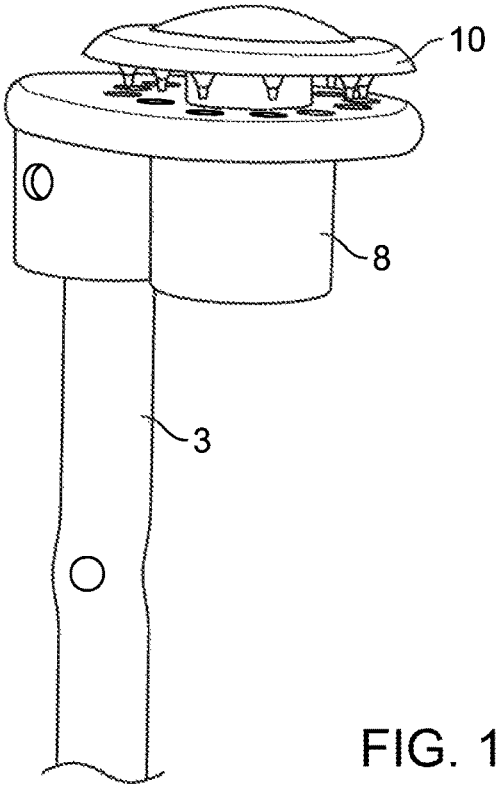
FIG. 17 is an enlarged side view of a capped connector of the frame of the collapsible target of FIG. 1.
Figure 18:
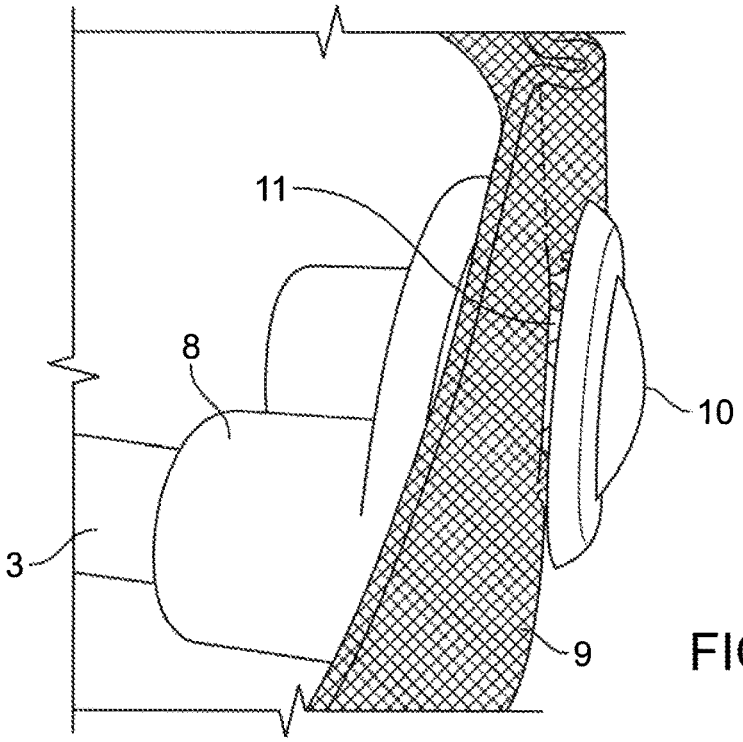
FIG. 18 is an enlarged side view of a capped connector and fabric housing of the frame of the collapsible target of FIG. 1.
Figure 19:
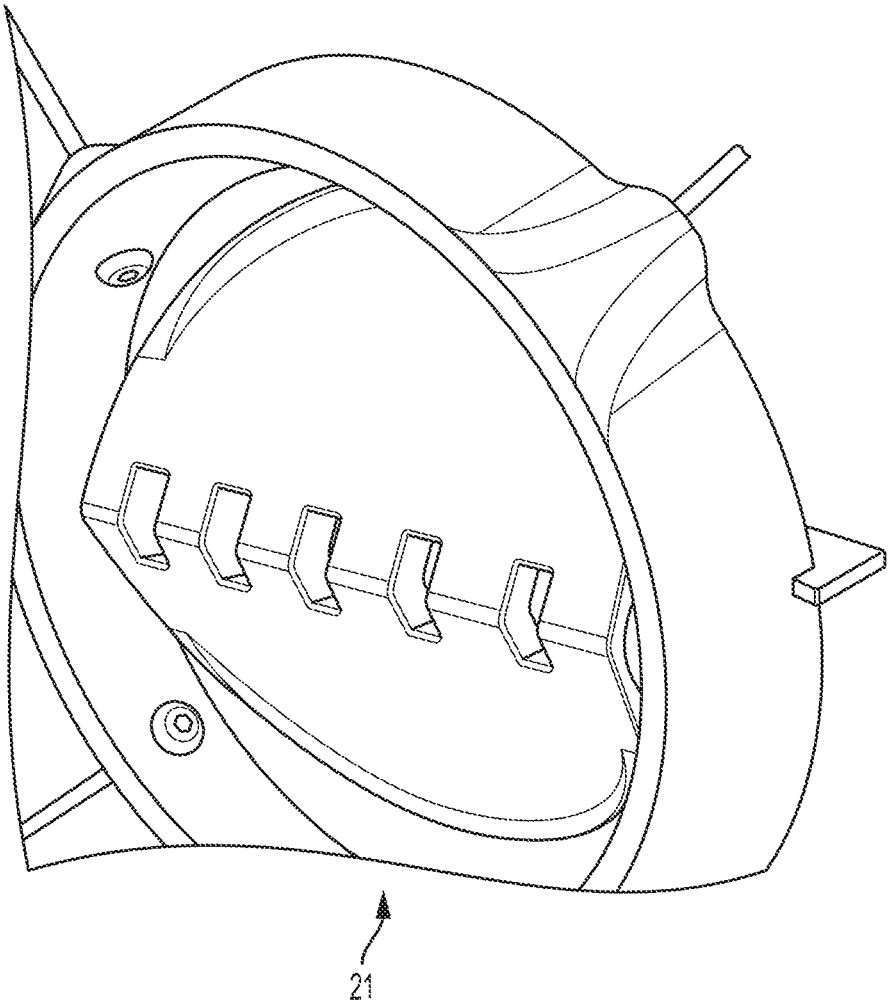
FIG. 19 is a perspective view of the target assembly of the collapsible target of FIG. 1.
Figure 20:
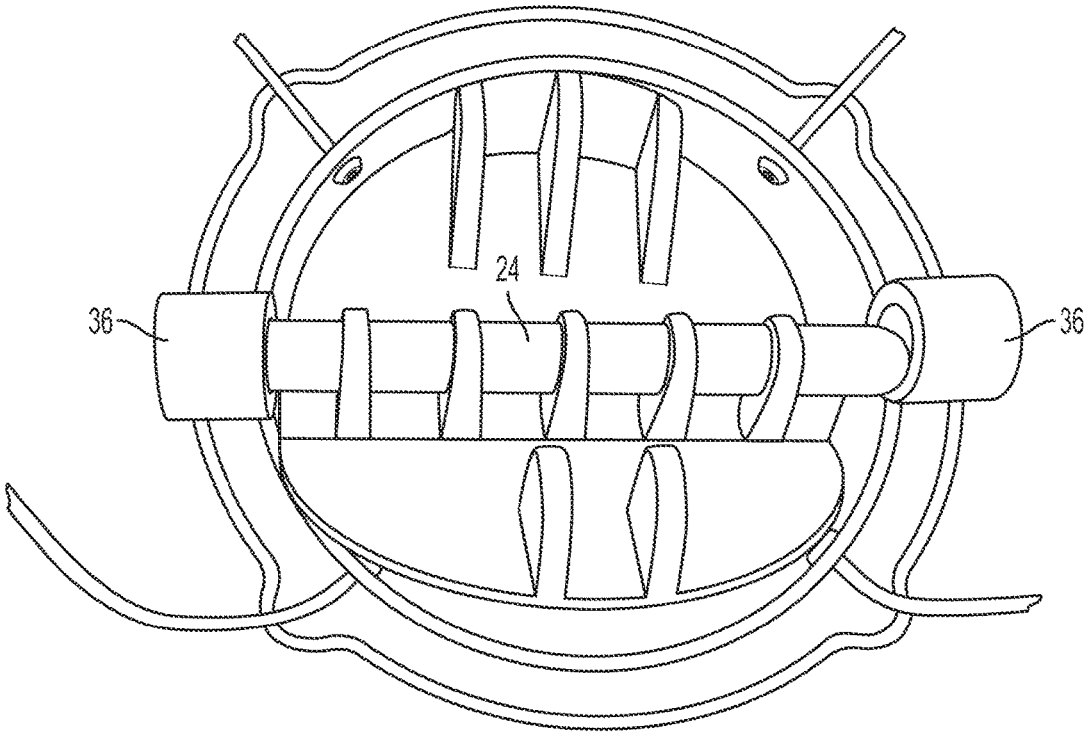
FIG. 20 is a rear perspective view of the target assembly of the collapsible target of FIG. 1.

Frame 2 comprises a plurality of tubular members 3 connected by joints 4 such that tubular members are movable relative to one another to allow frame 2 to open and close. When in the open, unfolded configuration (as seen in FIG. 14), tubular members 3 form front legs 5, rear legs 6, a horizontal mounting structure 7, and a vertical mounting structure 8. When in the closed, folded configuration, frame 2 converts to a compact, generally vertical structure that can be stored in a bag (not shown) and readily transported and stored.

A fabric housing 9 is mounted on frame 2 using a series of capped connectors 10 (the same connectors used to attach a prior art fabric seat to a prior art foldable chair frame, as disclosed in Zheng and as known to those skilled in the art) and grommets 11 such that housing 9 collapses when frame 2 is folded. Housing 9 in the disclosed embodiment is padded along its edges 12 and preferably includes an apron 13 covering front legs 5 of frame 2. Apron 13 advantageously prevents projectiles from being shot beneath target 1 and provides an aesthetically pleasing appearance.

Housing 9 comprises a plurality of panels joined together by sewing or otherwise. Front panel 14, side panels 15, rear panel 16, and bottom panel 17 together form the walls of an inner compartment 18. Compartment 18 has a generally right triangular cross-section, with front panel 14 forming one leg of the triangle, bottom panel 17 forming the other leg of the triangle, and rear panel 16 forming the hypotenuse of the triangle. Housing 9 preferably is formed of a strong, lightweight and durable material, such as nylon or polyester fabric. It will be appreciated by those skilled in the art that other fabrics may be used without departing from the scope of the present disclosure.

Rear panel 16 of compartment 18 is angled forwardly and downwardly such that projectiles entering compartment 18 and hitting rear panel 16 are advantageously directed toward the bottom of compartment 18 where a catch panel 19 is disposed, as further discussed below.

Front panel 14 of compartment 18 is formed with a window 20 covering substantially the entire area of front panel 14. Window 20 provides an opening into compartment 18. Behind window 20, and mounted within compartment 18 is a target assembly 21. Target assembly 21 comprises a base 22 and a self-resetting spinner 23 rotatably mounted within base 22.

Spinner 23 is mounted on a horizontal axle 24 and is angled and weighted such that the front face of spinner 23 will always reset (face toward the front of target 1) after being struck by a projectile, as further discussed below. Axle 24 is a generally rod shaped member and, in the disclosed embodiment, axle 24 is an illuminable member, such as a glowstick.

Spinner 23 comprises a generally circular body bent slightly along its diameter to form an upper portion 25 and a lower portion 26 with a peak 28 therebetween. At the intersection of upper portion 25 and lower portion 26 a plurality of apertures 27 are formed along the width of peak 28. Apertures are in alignment with axle 24 such that when axle 24 illuminates, the light passes through apertures 27 to allow target assembly 21 to be seen in low-light environments.

The rear of spinner 23 is formed with a plurality of loops 29 and grooves 30 for engaging and holding axle 24 and to permit spinner 23 to rotate about axle 24. Loops 29 in the disclosed embodiment are disposed generally in alignment with apertures 27, while grooves 30 are disposed between apertures 27. The rear of spinner 23 is further formed with upper projections 31 and lower projections 32. Upper projections 31 and lower projections 32 serve as weights configured to cause spinner 23 to reset (face toward the front of target 1) after being struck by a projectile.

That is, the number of upper projections 31 is smaller than the number of lower projections 32. This causes spinner 23 to be bottom-heavy such that when spinner 23 rotates about axle 24 after being struck by a projectile, gravity will cause lower portion 26 of spinner 23, which is heavier than upper portion 25 of spinner 23 and which is angled rearward, to position itself beneath upper portion 25 thereby causing spinner 23 for face forward. Upper projections 31 and lower projections 32 are weighted such that spinner is balanced in a generally centered position when spinner 23 is stationary.

Base 22 is a generally circular, O-shaped member. Base 22 comprises a plurality of posts 33 mounted to and extending inwardly from an inner circumference of base 22. Posts 33 are configured to receive the ends of two lengths of flexible rubber tubing 34, 35 as further discussed below, such that the posts 33 are inserted into the ends of tubing 34, 35 to achieve a friction fit therebetween. Other connection methods between tubing 34, 35 and base 22 are possible, such as rivets, screws, adhesives, and the like, and all such connection methods are included within the scope of the present disclosure. The posts 33 may rotate or swivel to flexibly accommodate the rubber tubing 34, 35.

Base 22 is formed with a pair of receptacles 36 for receiving and holding the ends of axle 24. Receptacles 36 are formed by joining bases 37 and lids 38, each of which are connected to the inner circumference of base 22 by a living hinge and are configured to frictionally engage one another such that receptacles 36 are formed on the rear of base 22 and across the inner and outer diameters of base 22. Receptacles 36 are dimensioned, as noted above, to receive the ends of axle 24 with spinner 23 rotatably mounted thereon. Axle 24 may be readily removed and replaced in order to remove spinner 23 and/or, if a glowstick is being used for axle 24, to replace the glowstick.

Base 22 is further formed with a plurality of grooves 39 formed along the outer circumference of base 22 and configured to engage the portions of tubing 34, 35 that cross the outer circumference of base 22. Grooves 39 are aligned generally with posts 22 where the ends of tubing 34, 35 attach to base 22. In this manner, grooves 39 permit base 22 to lie straight and serve as a guide within which tubing 34, 35 advantageously may be disposed to keep tubing 34, 35 in proper alignment with base 22.

Figure 21:
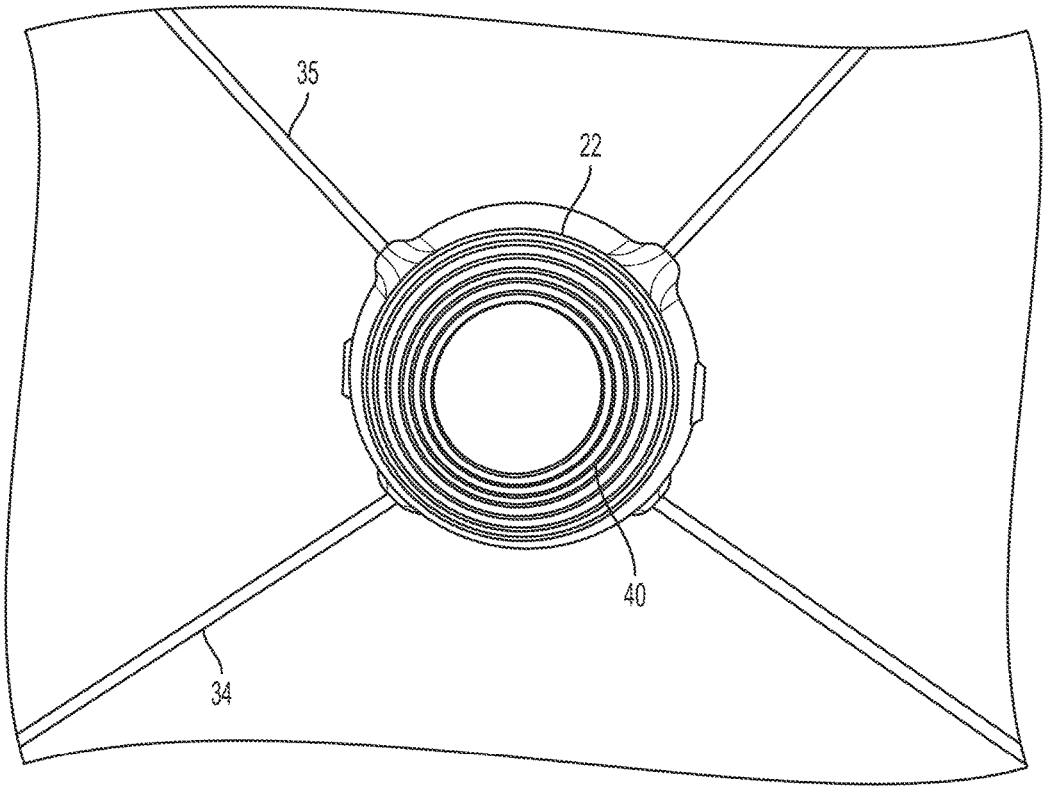
FIG. 21 is a front view of the target assembly of the collapsible target of FIG. 1, the base holding a clay target.
Figure 22:
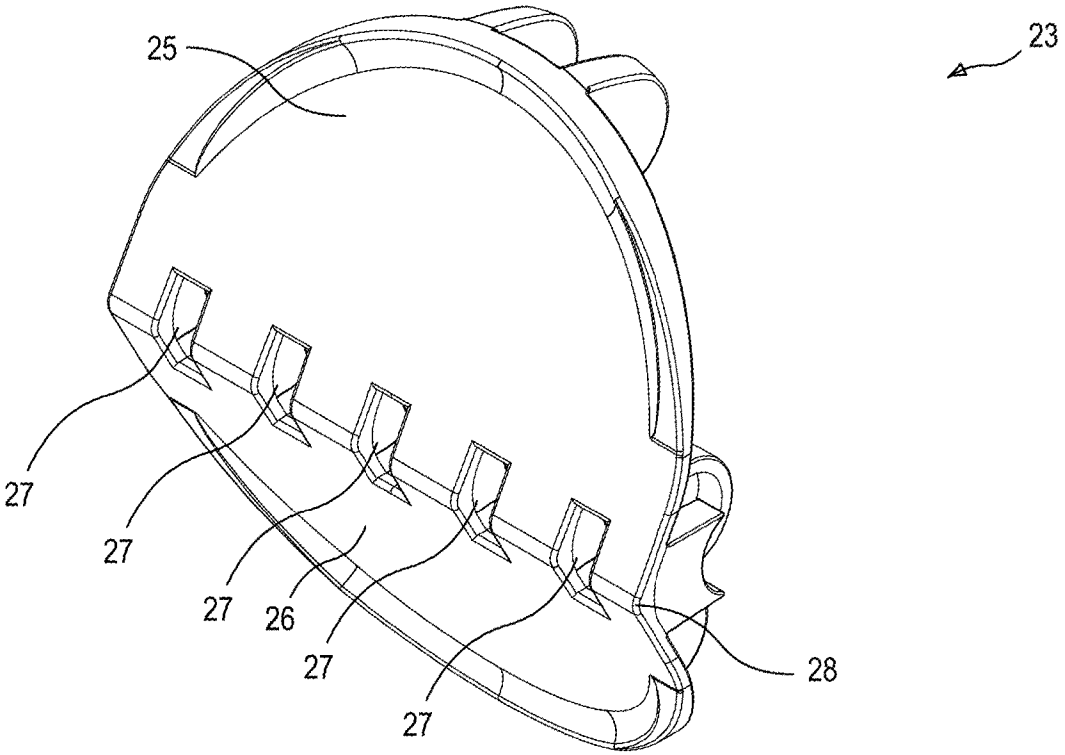
FIG. 22 is a perspective view of the spinner of the target assembly of the collapsible target of FIG. 1.
Figure 23:
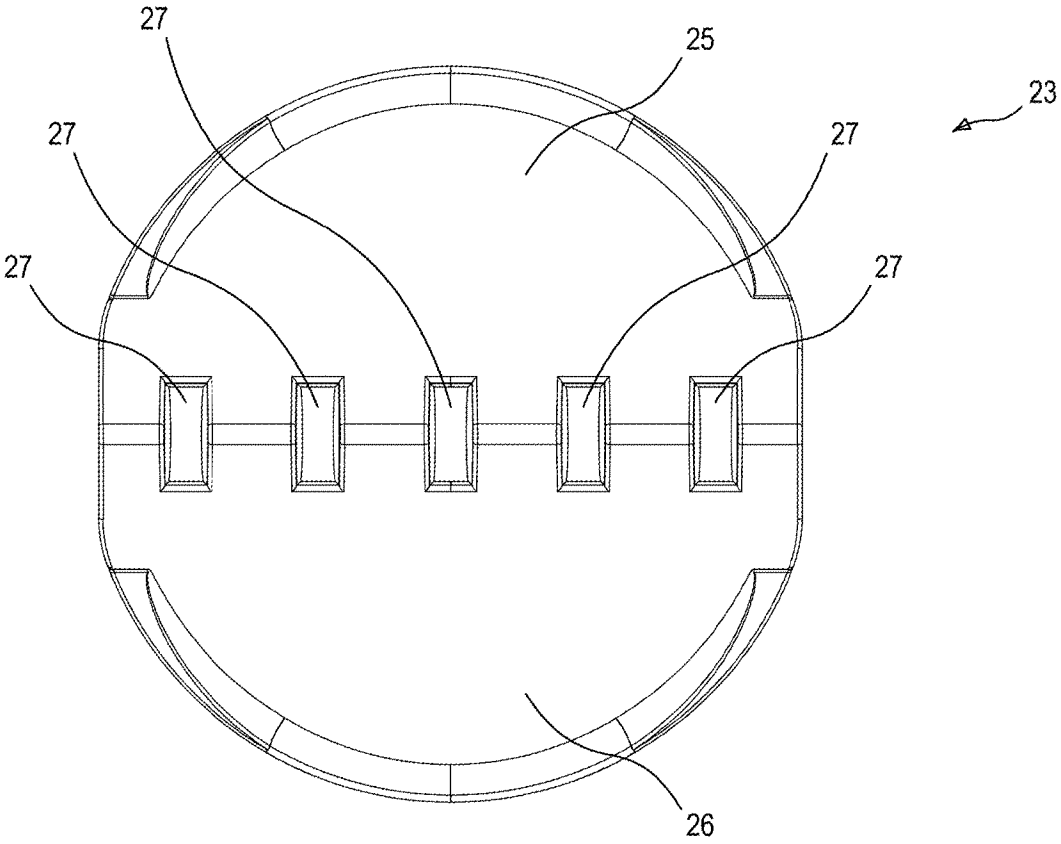
FIG. 23 is a front view of the spinner of the target assembly of the collapsible target of FIG. 1.
Figure 24:
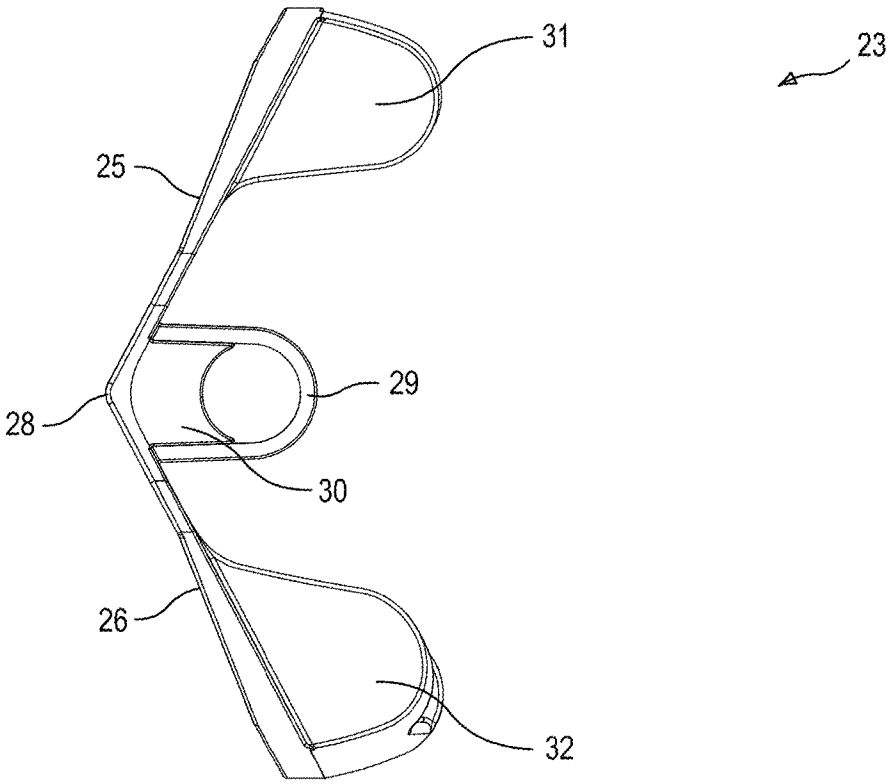
FIG. 24 is a right side view of the spinner of the target assembly of the collapsible target of FIG. 1.
Figure 25:
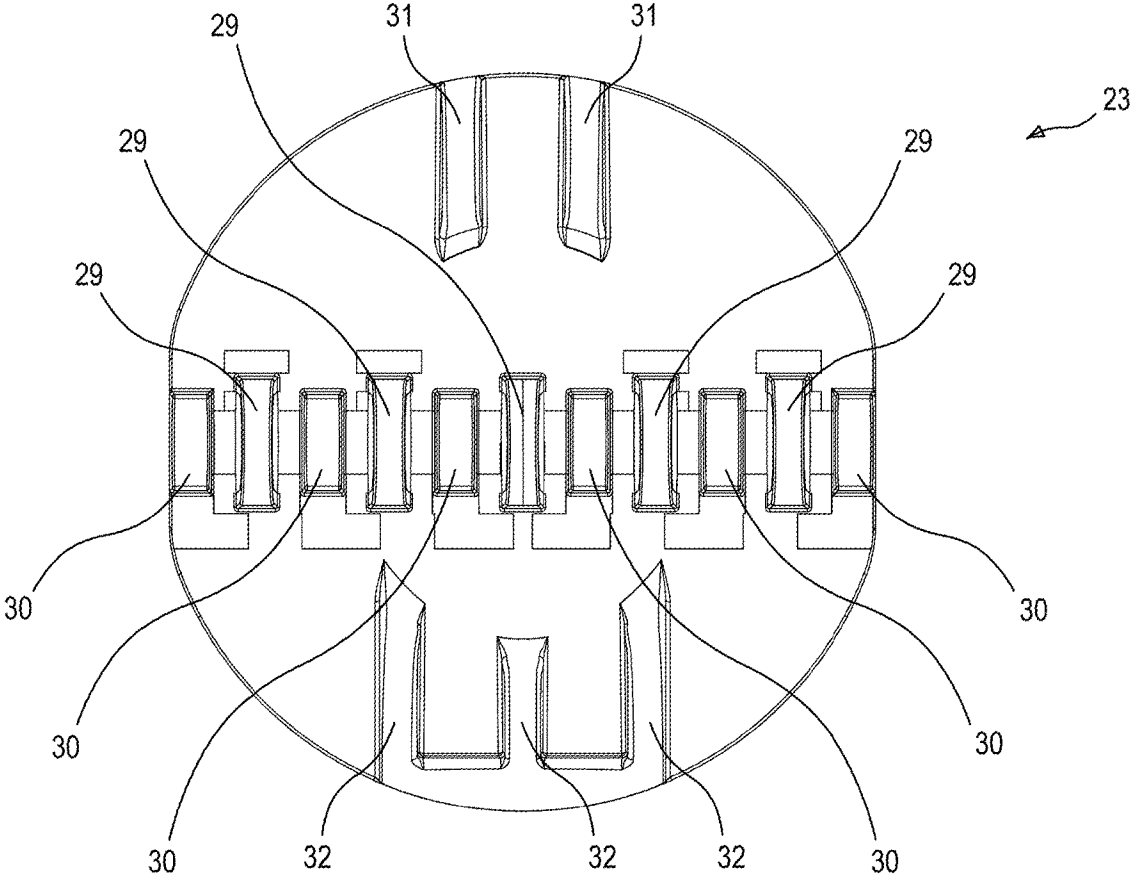
FIG. 25 is a rear view of the spinner of the target assembly of the collapsible target of FIG. 1.
Figure 26:
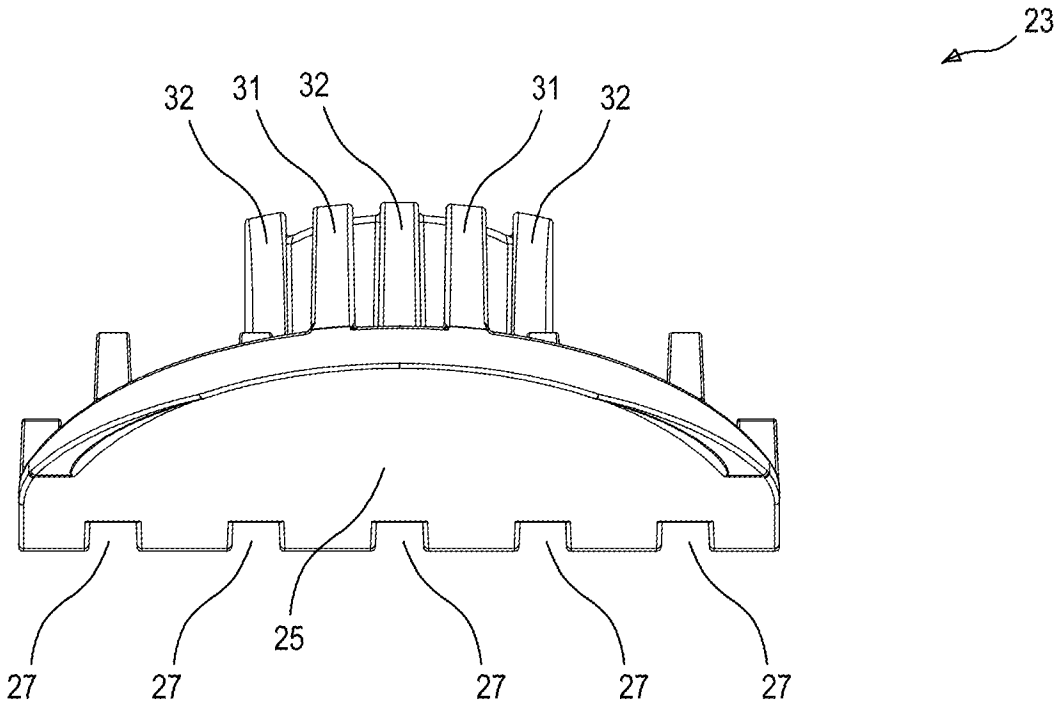
FIG. 26 is a top view of the spinner of the target assembly of the collapsible target of FIG. 1.
Figure 27:
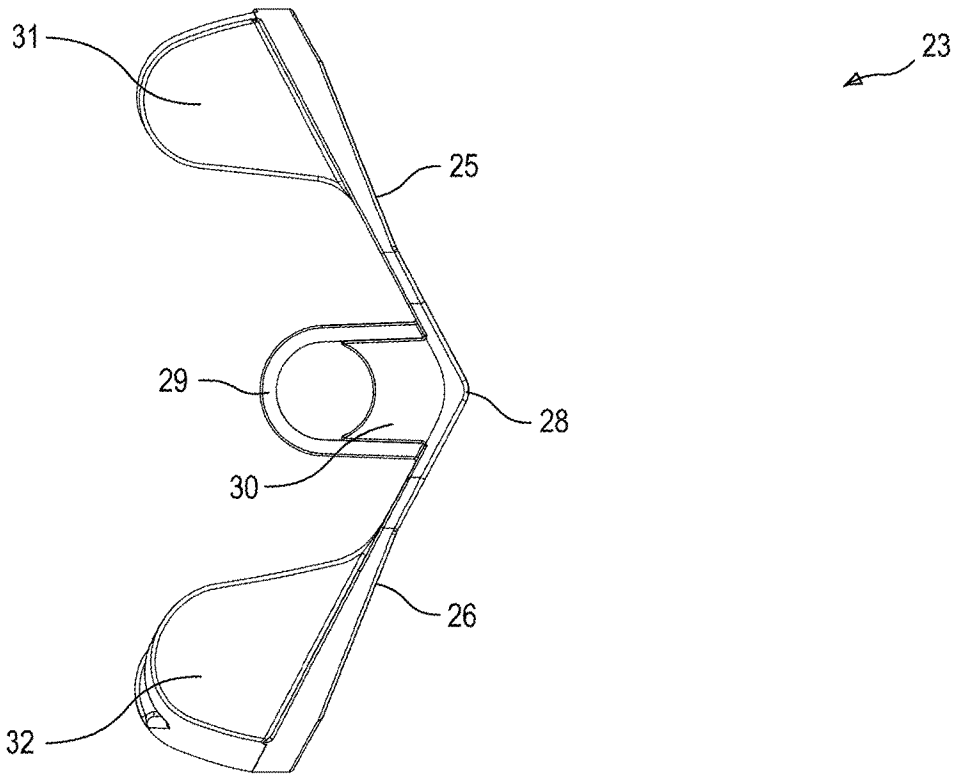
FIG. 27 left side view of the spinner of the target assembly of the collapsible target of FIG. 1.
Figure 28:
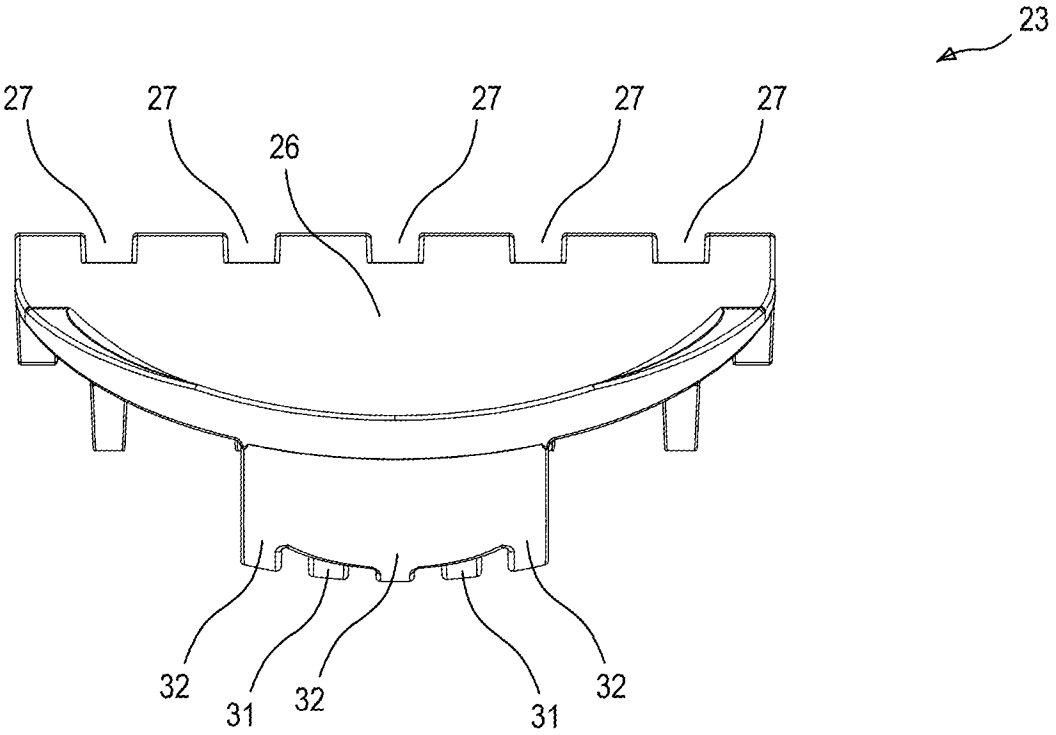
FIG. 28 is a bottom view of the spinner of the target assembly of the collapsible target of FIG. 1.
Figure 29:
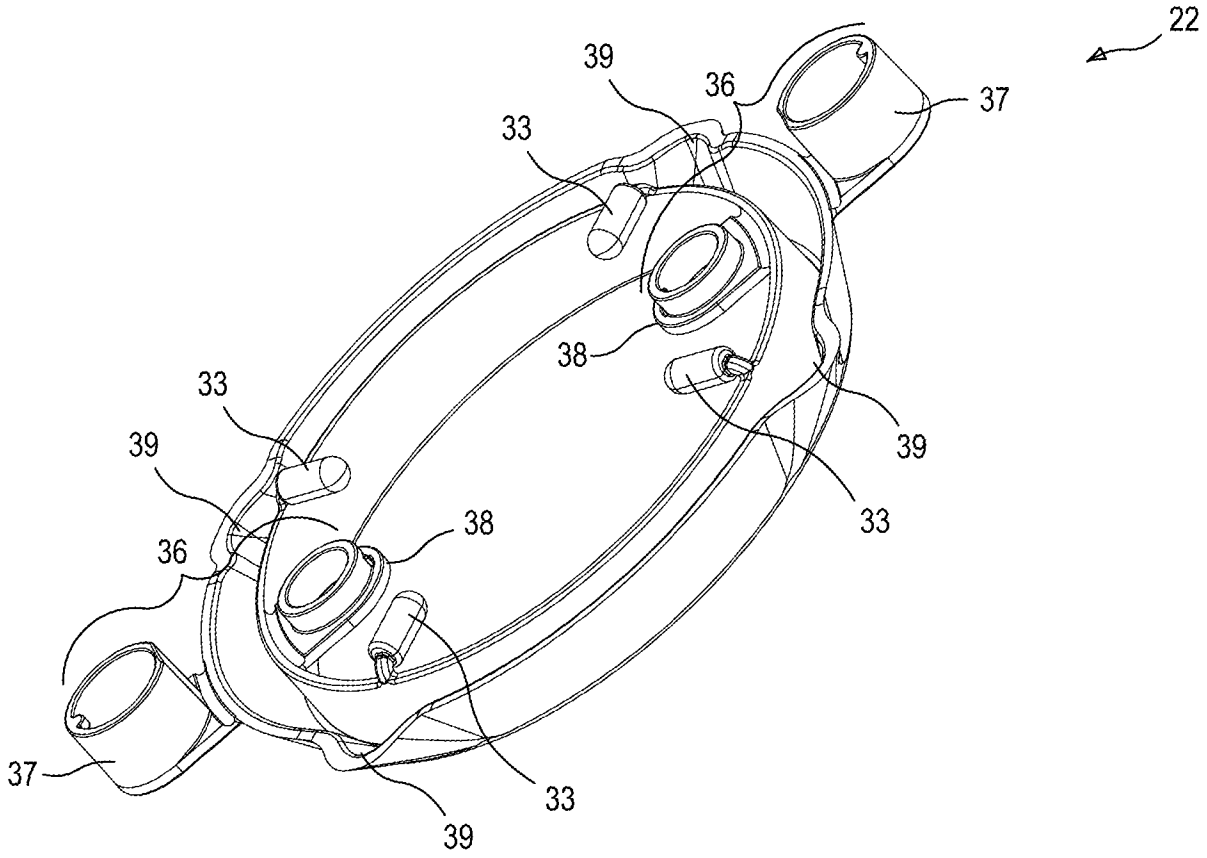
FIG. 29 is a perspective view of the base of the target assembly of the collapsible target of FIG. 1.
Figure 30:
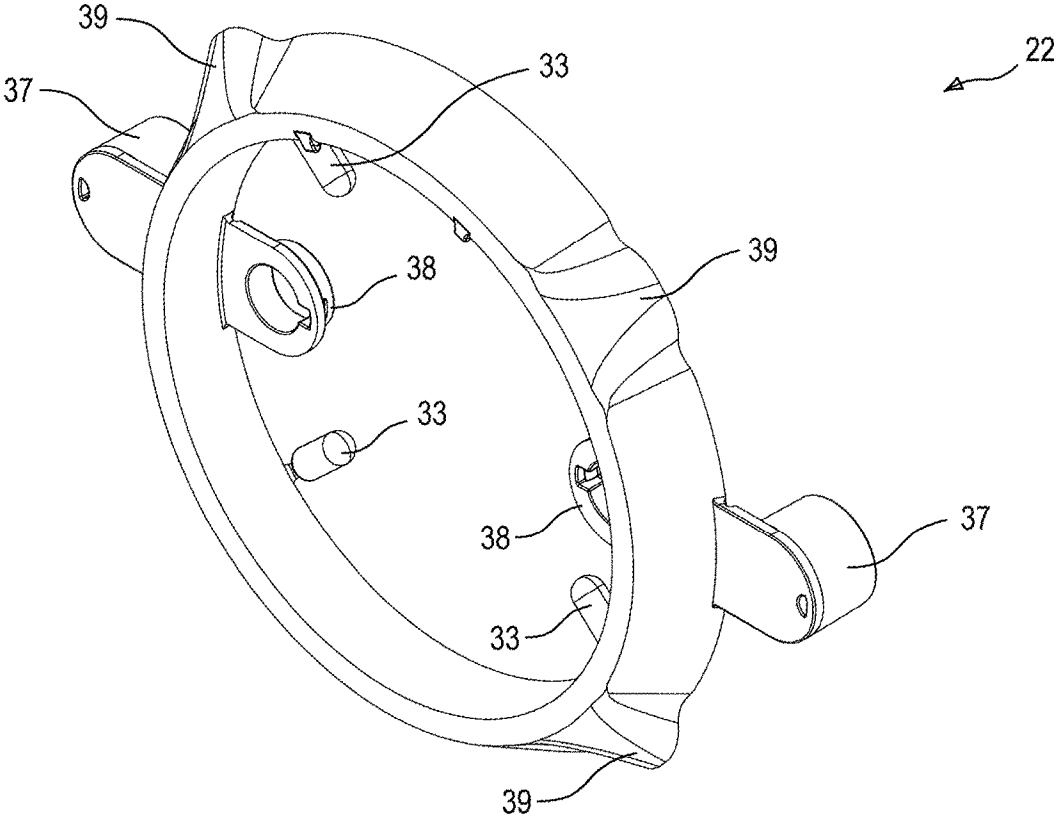
FIG. 30 is a perspective view of the base of the target assembly of the collapsible target of FIG. 1.
Figure 31:
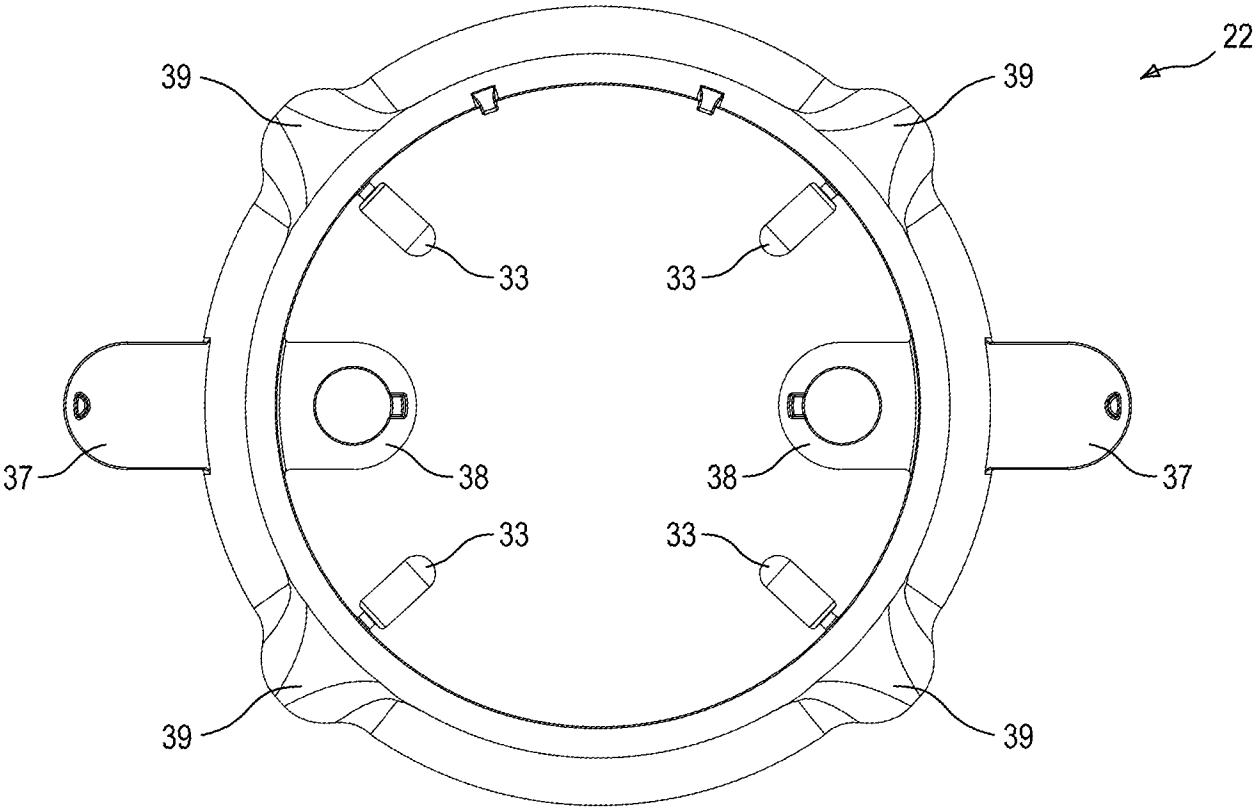
FIG. 31 is a front view of the base of the target assembly of the collapsible target of FIG. 1.
Figure 32:
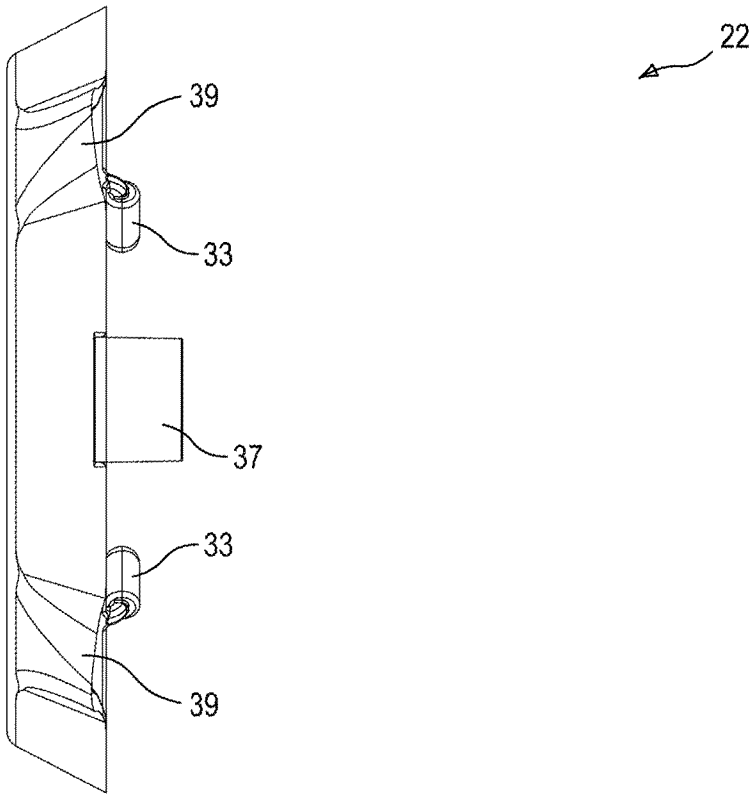
FIG. 32 is a right side view of the base of the target assembly of the collapsible target of FIG. 1.
Figure 33:
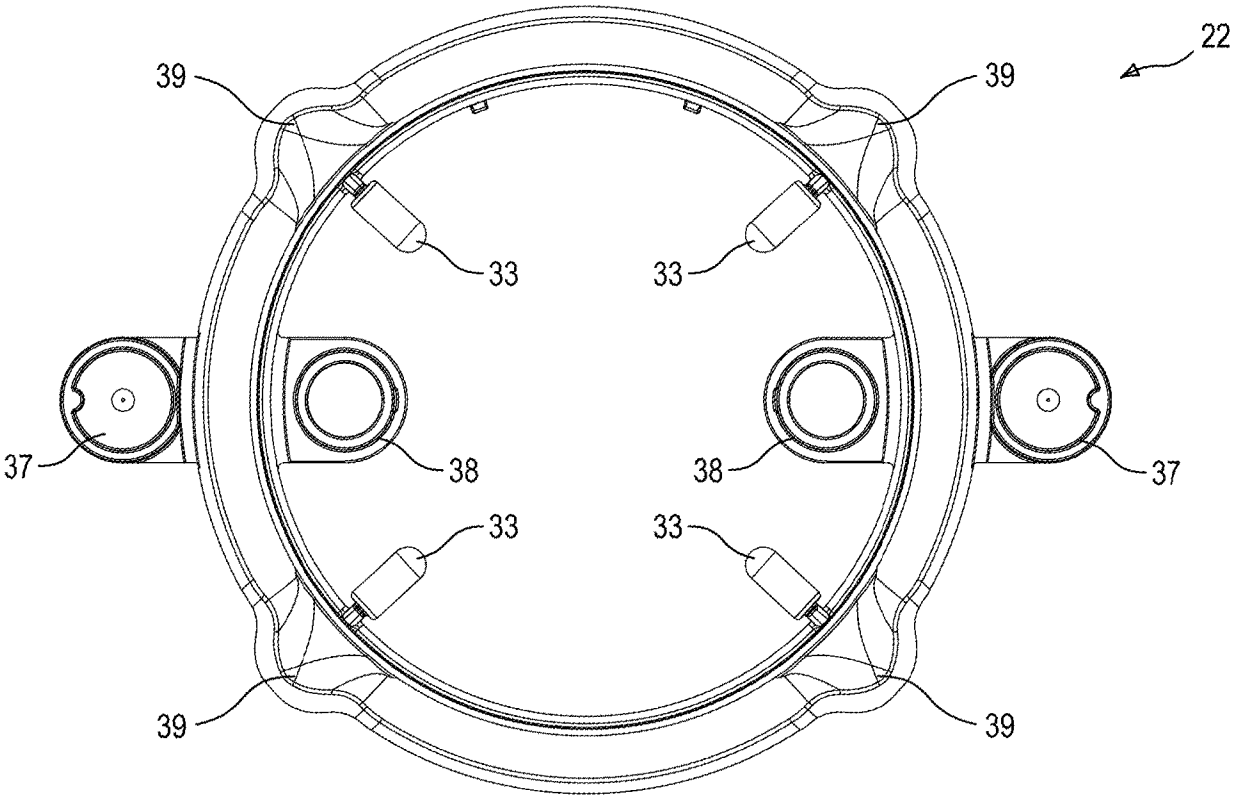
FIG. 33 is a rear view of the base of the target assembly of the collapsible target of FIG. 1.
Figure 34:
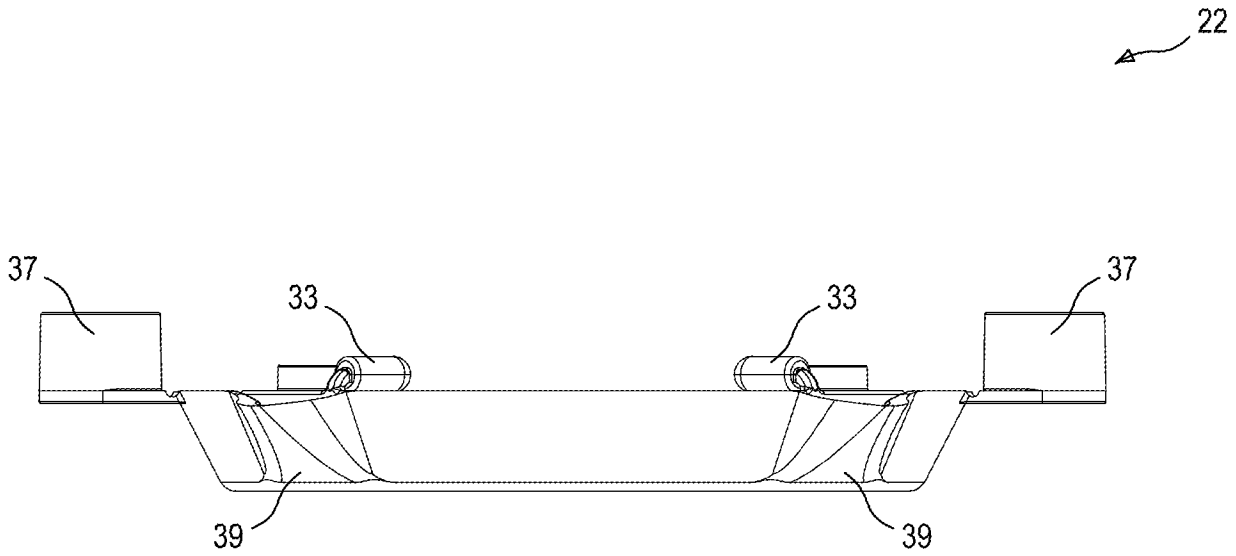
FIG. 34 is a top view of the base of the target assembly of the collapsible target of FIG. 1.
Figure 35:
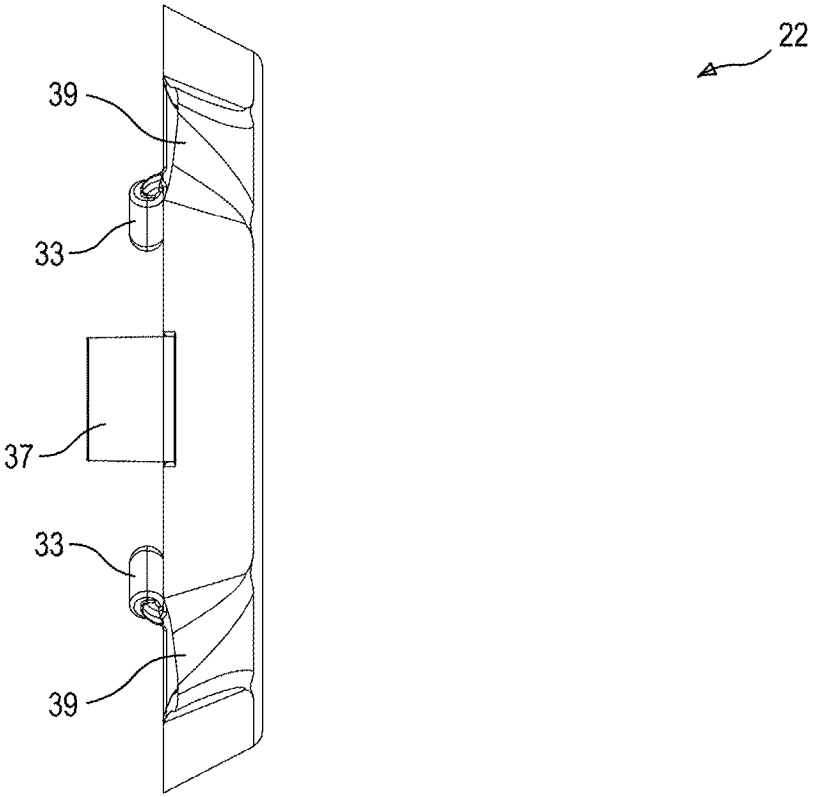
FIG. 35 is a left side view of the base of the target assembly of the collapsible target of FIG. 1.
Figure 36:
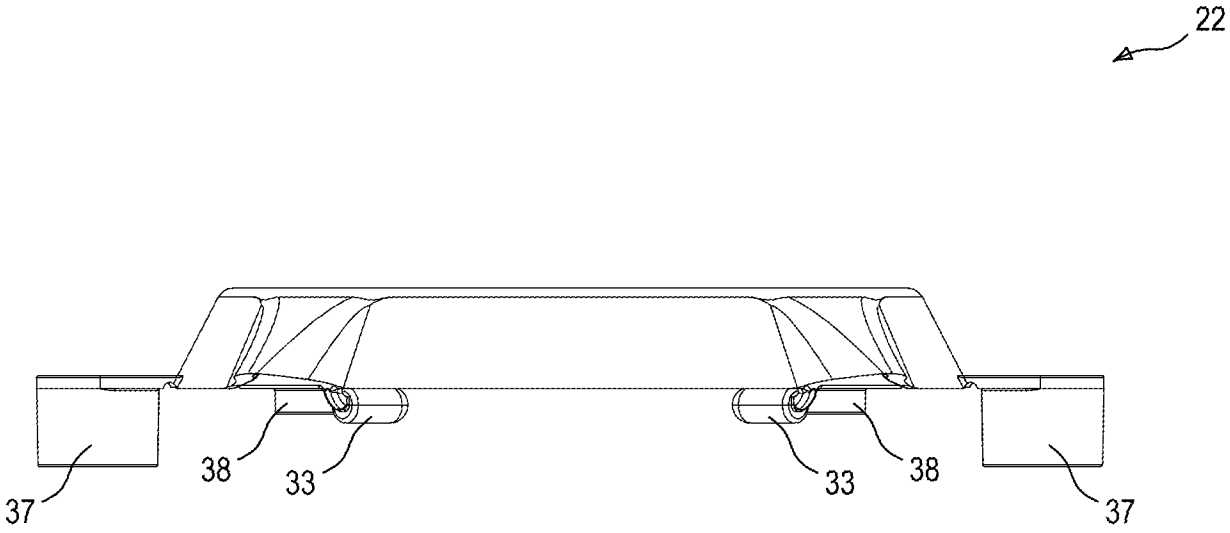
FIG. 36 is a bottom view of the base of the target assembly of the collapsible target of FIG. 1.
Figure 37:
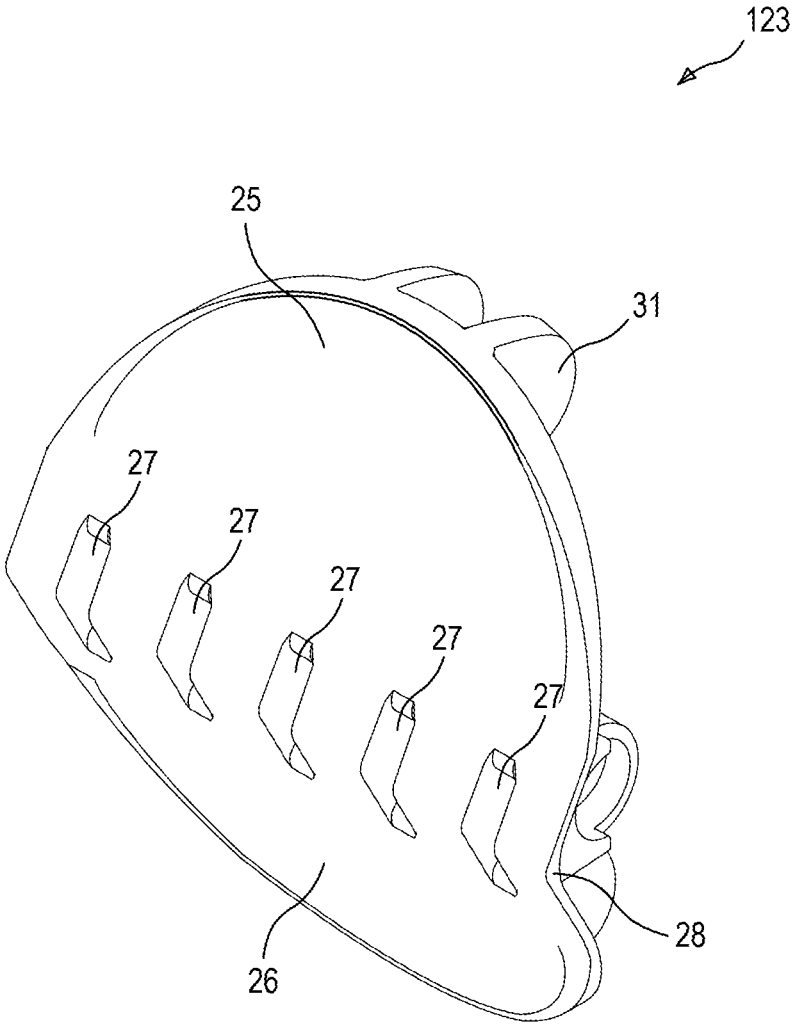
FIG. 37 is a front perspective view of a spinner of a target assembly according to another embodiment.

Base 22 is configured not only to hold spinner 23 but also to alternatively hold a traditional clay (breakable) target 40 as is known in the art. To use target 40, spinner 23 may be removed and target 30 may be friction fit within base 20 as shown in FIG. 21.

As noted above, two lengths of flexible rubber tubing 34, 35 are used to mount target assembly 21 to target 1 and to suspend target assembly within compartment 18 and generally centered behind window 20. To accomplish this, a first length of tubing 34 connects to the lower half of base 22 and a second length of tubing 35 connects to the upper half of base 22.

More specifically, a first end of first length of tubing 34 is mounted to a left post 33 on the lower half of base 22. Tubing then 34 extends to a hook 41 located in the bottom left corner of compartment 18, across the bottom front of compartment 18 and through another hook 41, and then back to base 22 where the second end of the first length of tubing 34 is mounted to a right post 33 on the lower half of base 22.

Similarly, a first end of second length of tubing 35 is mounted to a left post 33 on the upper half of base 22. Tubing 35 then extends to a hook 41 located in the upper left corner of compartment 18, across the top front of compartment 18 and through another hook 41, and then back to base 22 where the second end of the second length of tubing 35 is mounted to a right post 33 on the upper half of base 22.

In the disclosed embodiment of target 1, catch panel 19 is mounted between the lengths of tubing 34, 35 within compartment 18, with holes in the corners of catch panel 19 allowing tubing 34, 35 to pass therethrough. Catch panel 19 preferably is angled forwardly such that projectiles entering compartment 18 and landing on catch panel 19 may roll to the front of compartment 18 for easy retrieval.

FIGS. 37-44 show various views of the spinner 123 according another embodiment. FIGS. 45-52 show various views of the base 122 according to another embodiment, and FIGS. 53-60 show various views of the target assembly 121, incorporating the spinner 123 and base 122 of FIGS. 37-44 and FIGS. 45-52, respectively.

It is understood that various features of the embodiments shown in FIGS. 37-60 may be similar or identical to the features described above with reference to FIGS. 1-36, and that further description of these features may be omitted below. In addition, certain features described below that are similar or identical to features described above may be referenced below and shown in FIGS. 37-60 using the same reference numbers as above.

Figure 38:
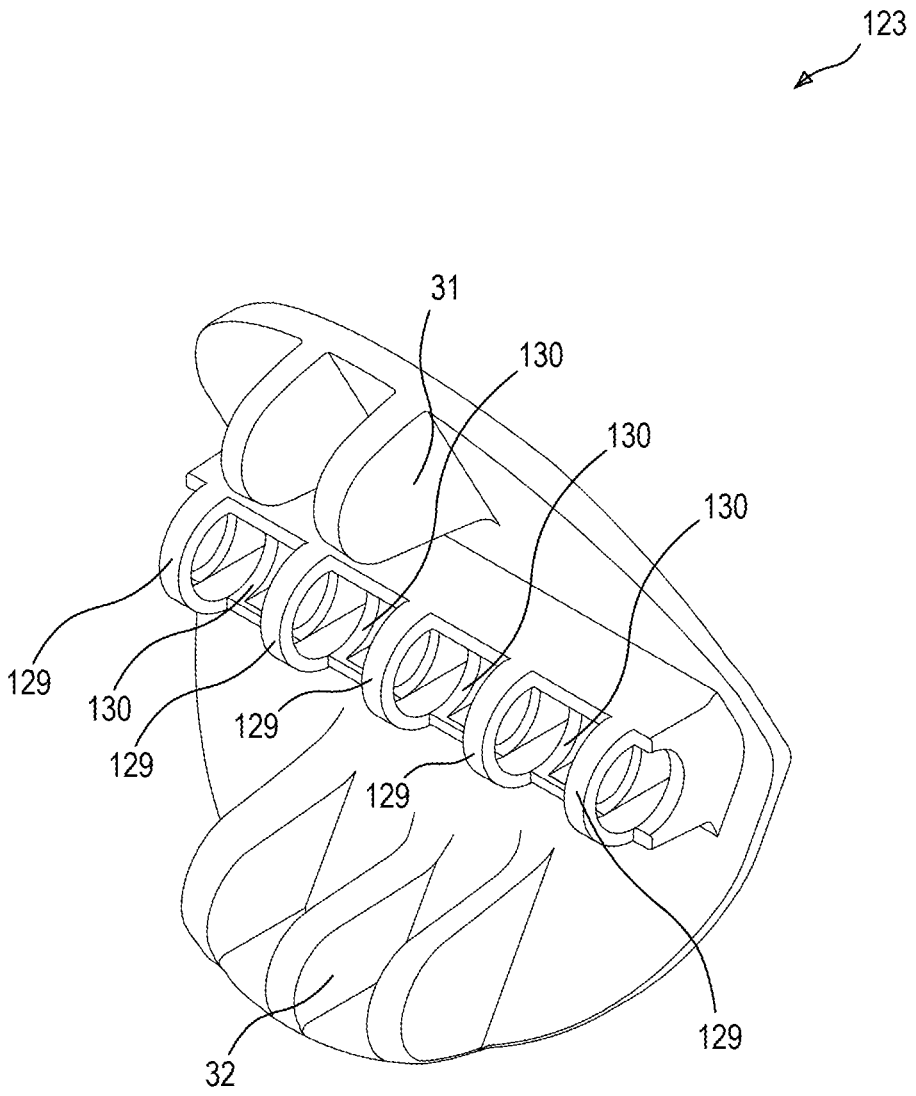
FIG. 38 is a rear perspective view of the spinner of FIG. 37.
Figure 39:
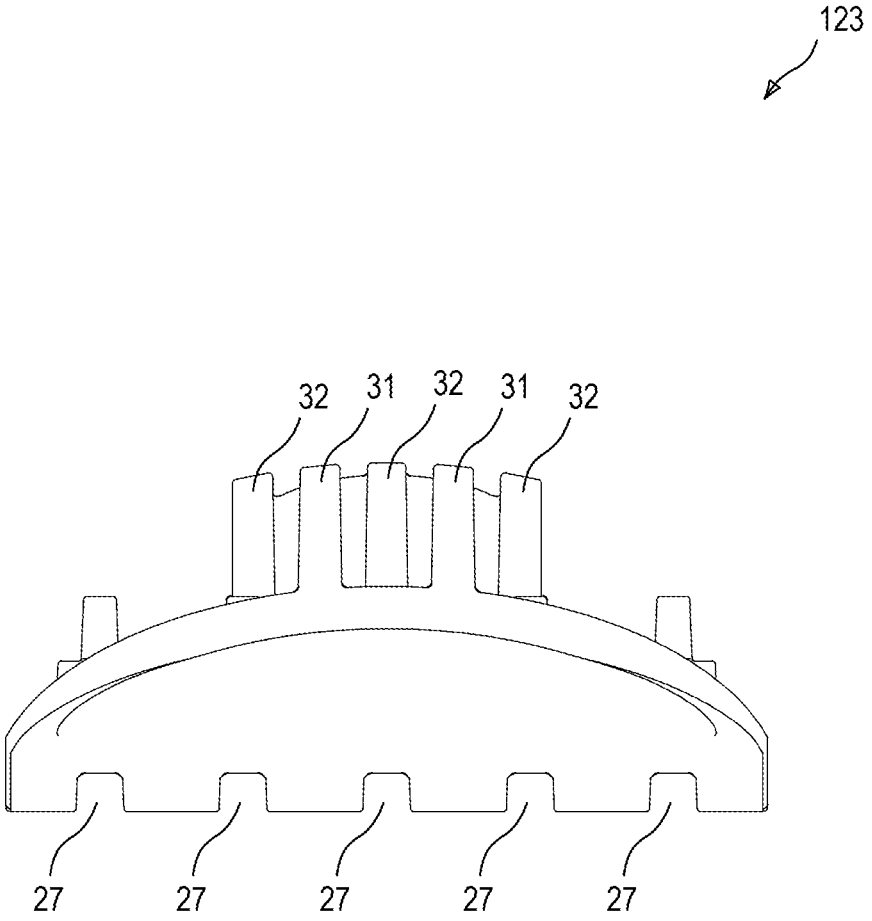
FIG. 39 is a top view of the spinner of FIG. 37.
Figure 40:
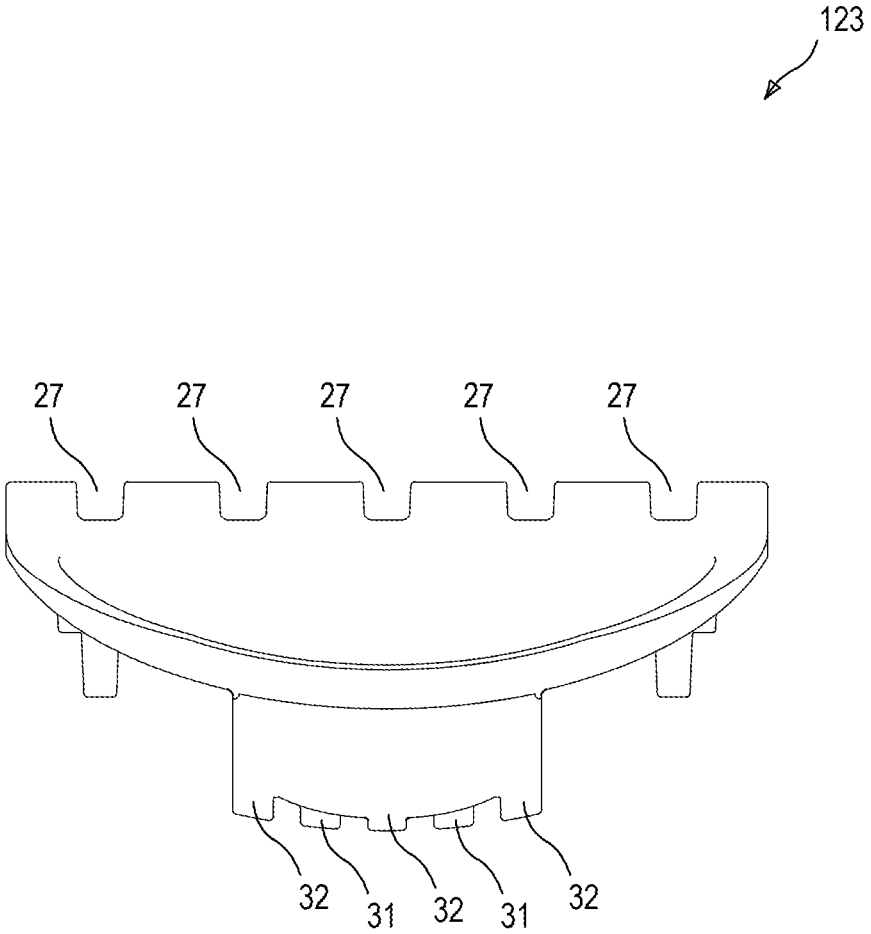
FIG. 40 is a bottom view of the spinner of FIG. 37.
Figure 41:
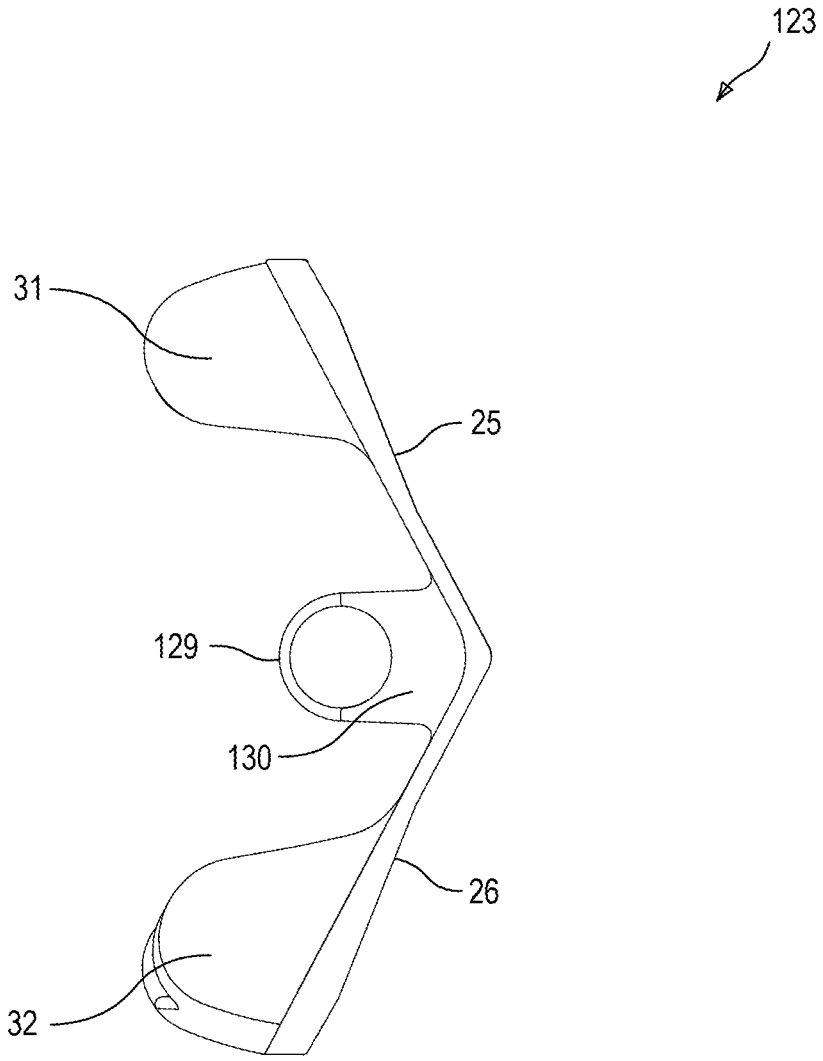
FIG. 41 is a left side view of the spinner of FIG. 37.
Figure 42:
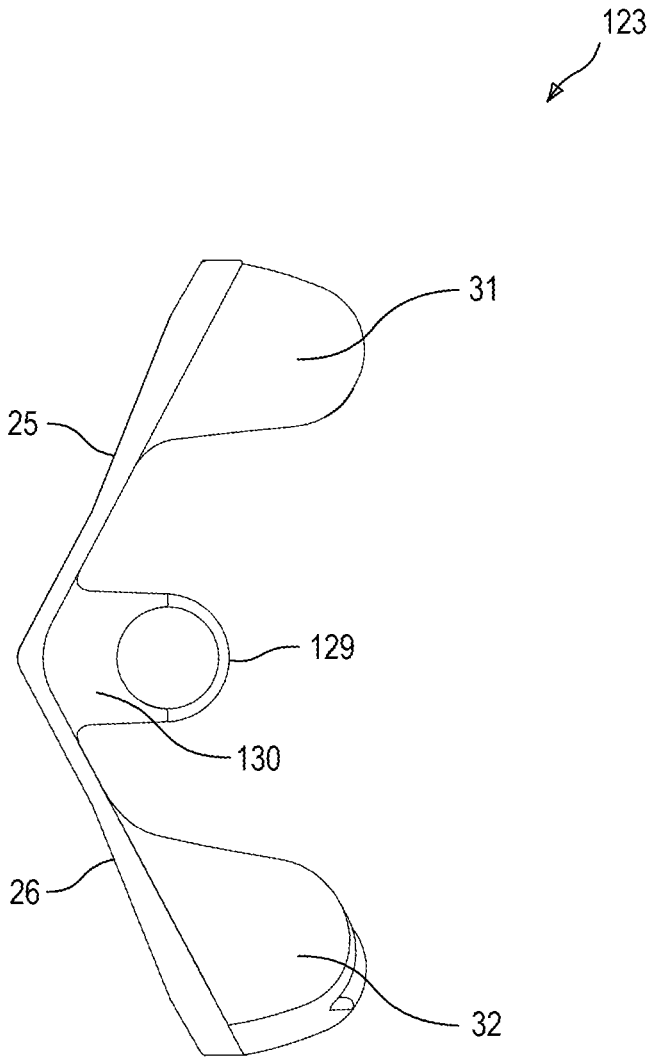
FIG. 42 is a right side view of the spinner of FIG. 37.
Figure 43:
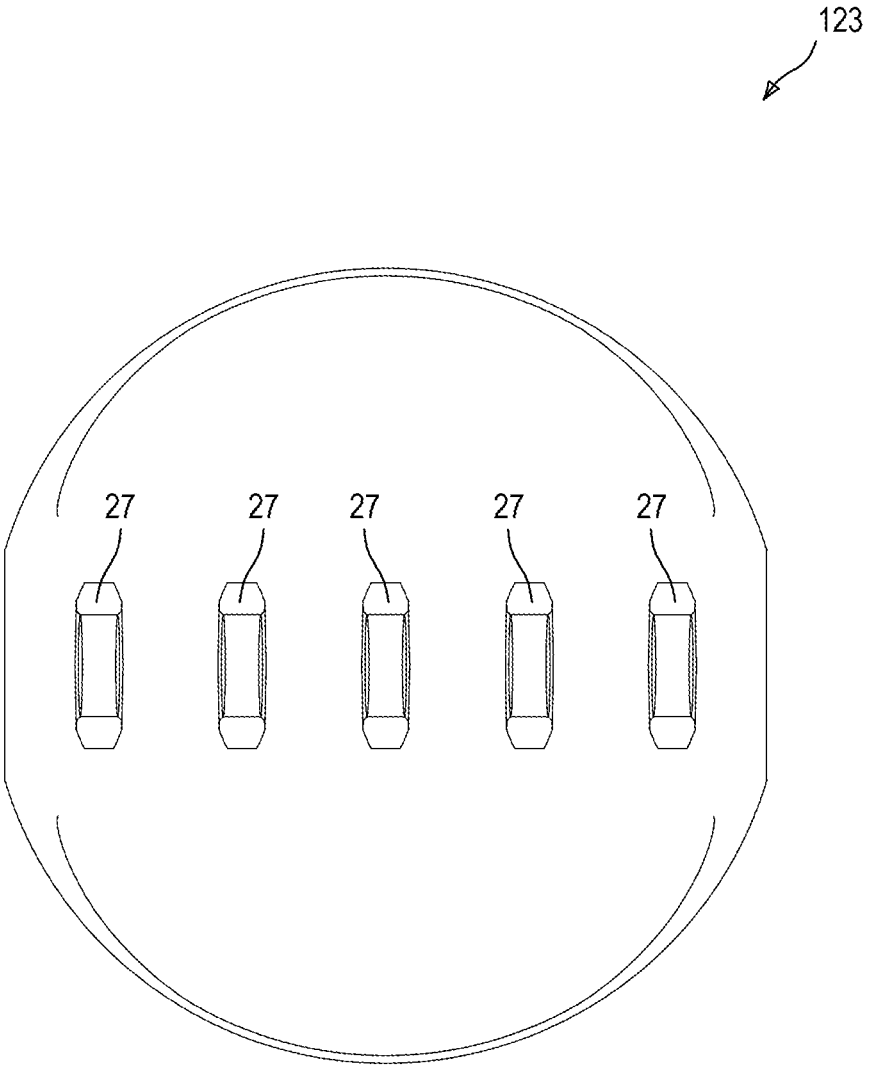
FIG. 43 is a front view of the spinner of FIG. 37.
Figure 44:
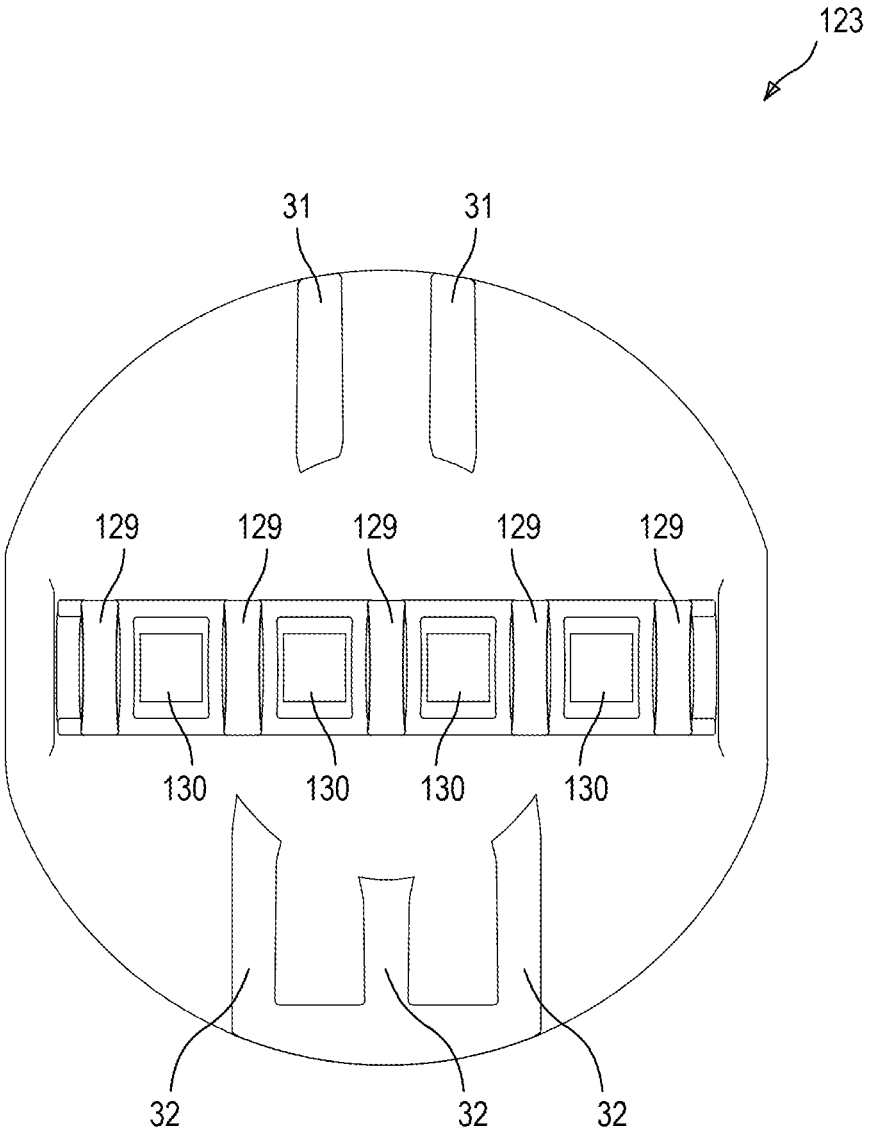
FIG. 44 is a rear view of the spinner of FIG. 37.
Figure 45:
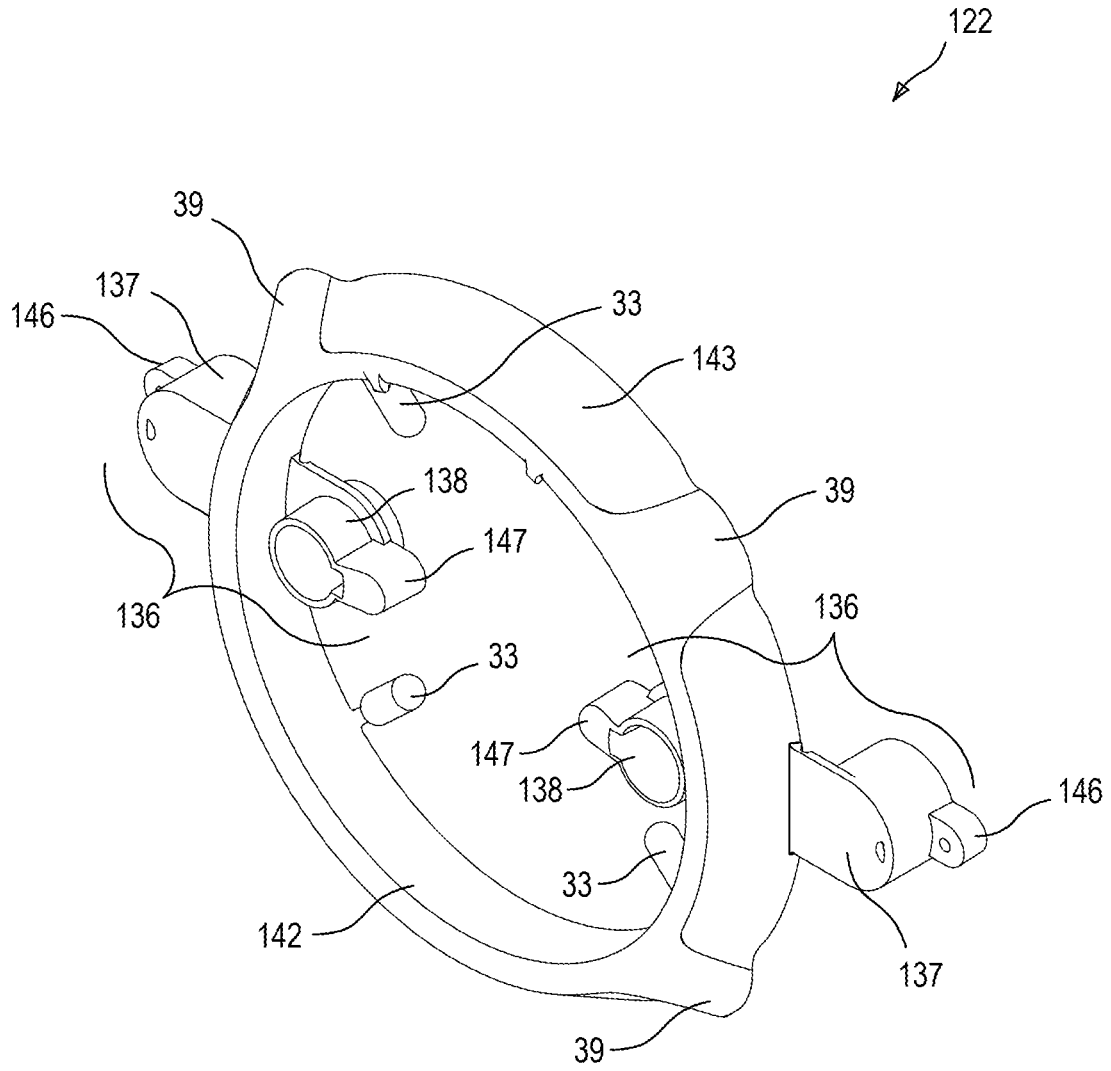
FIG. 45 is a front perspective view of a base of a target assembly according to another embodiment.

Referring generally to FIGS. 37-44, and in particular to FIGS. 38 and 44, the spinner 123, at a rear side, is formed with a plurality loops 129 and grooves 130 for engaging and holding the axle 24. The loops 129 may generally be disposed in alignment with apertures 27, and grooves 130 are disposed between the loops 129. As further shown in FIG. 38, in this embodiment, the loops 129 and grooves 130 are formed integrally along their length. That is, the plurality of loops 129 and grooves 130 are formed in a single piece of material.

It is understood that the configuration of the spinner is not limited to the examples described above. For example, the spinner may be formed as a substantially flat element, rather than be angled about a diameter thereof. In addition, the spinner may be a two part spinner, having a front plate and a back plate. The front plate and the back plate may be secured to each other using suitable known fastening techniques, including, but not limited to, adhesives, bolts, screws, clips, snaps and/or clamps. The front plate and/or back plate may be substantially flat, disk like members, or angled as described above. In addition, the front plate and back plate may be differently colored, for example, during a molding process. Providing different colors for the front plate and back plate may provide a visual confirmation that the spinner is rotating about the axle, for example, after being struck by a projectile.

Figure 46:
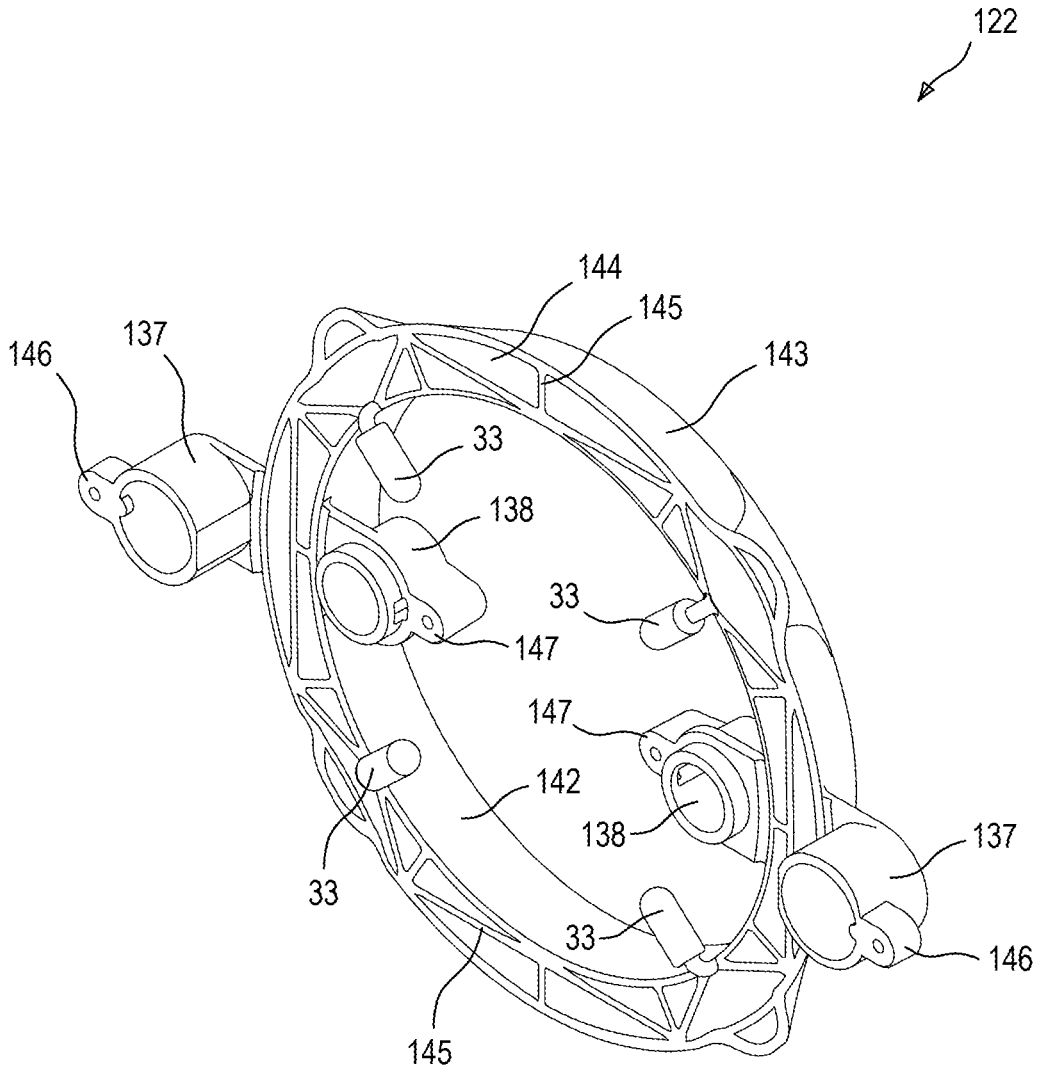
FIG. 46 is a rear perspective view of the base of FIG. 45.
Figure 47:
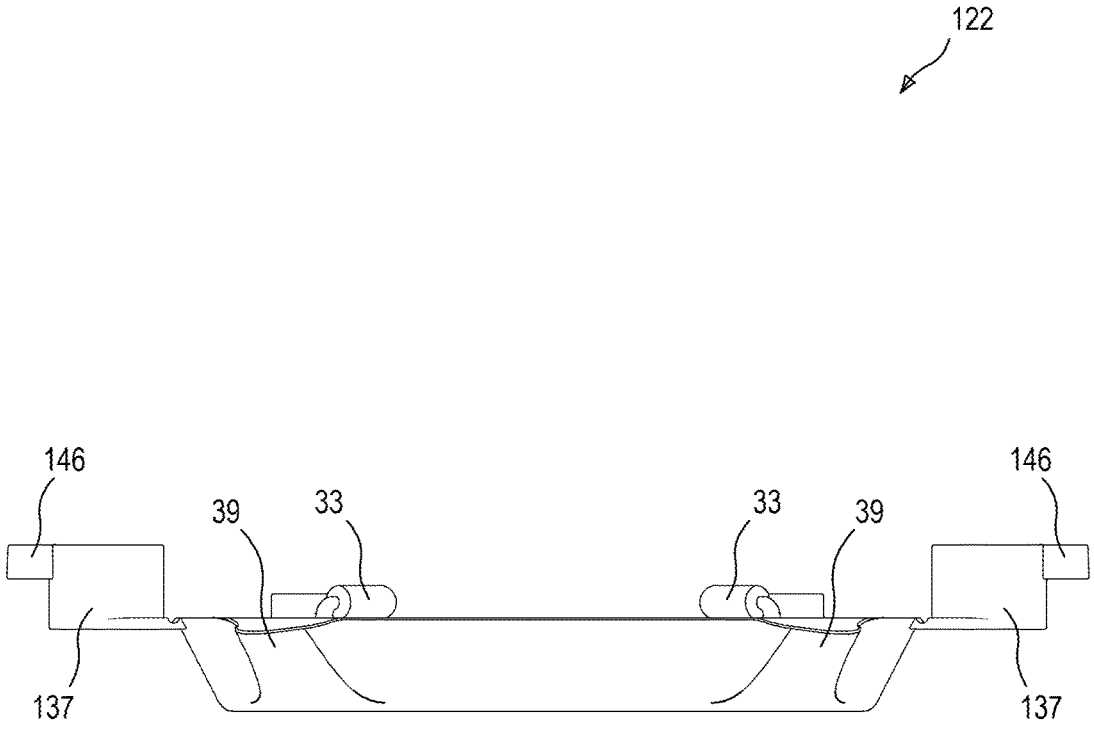
FIG. 47 is a top view of the base of FIG. 45.
Figure 48:
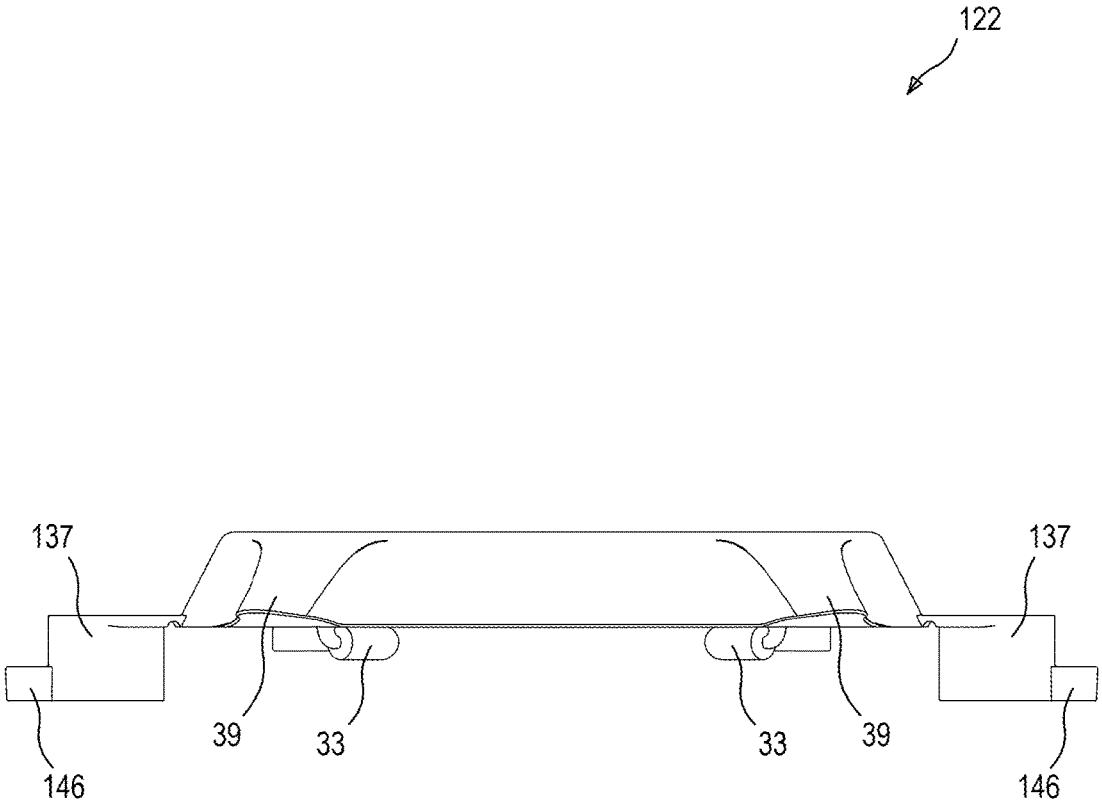
FIG. 48 is a bottom view of the base of FIG. 45.
Figure 49:
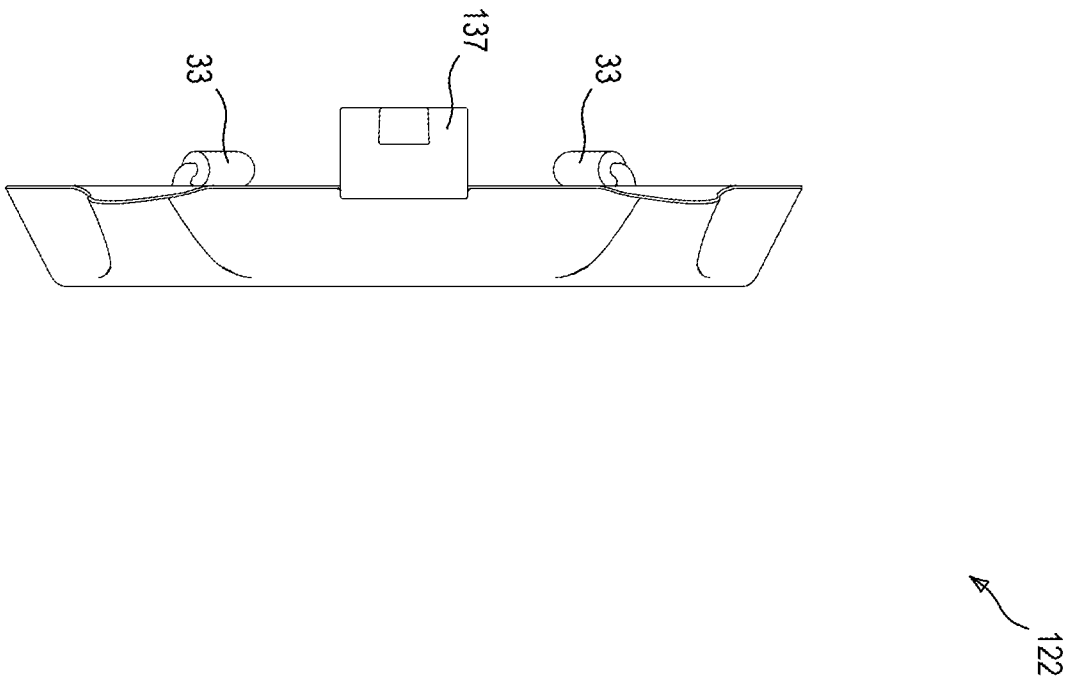
FIG. 49 is a left side view of the base of FIG. 45.
Figure 50:
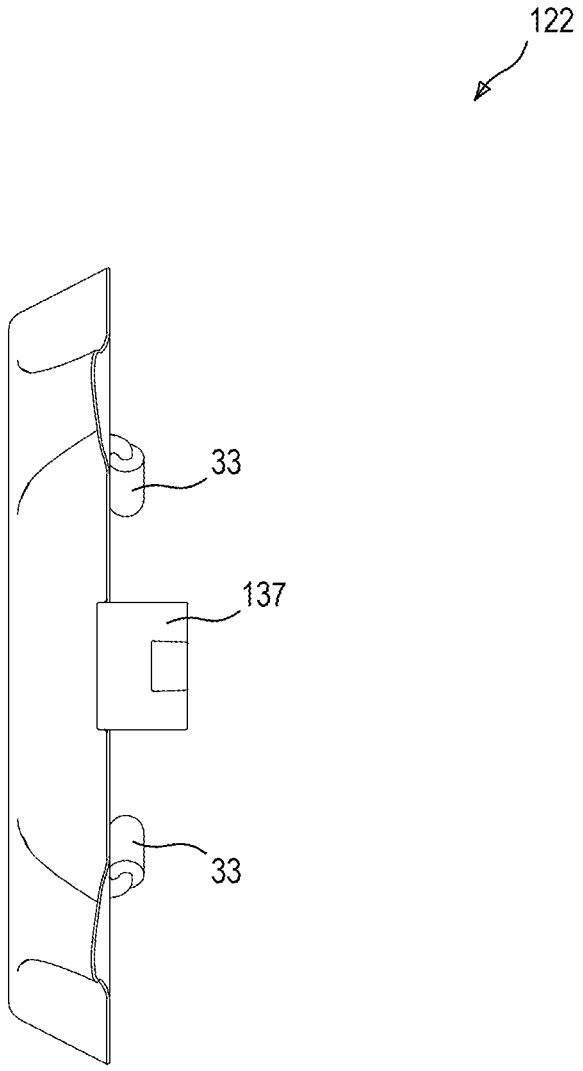
FIG. 50 is a right side view of the base of FIG. 45.
Figure 51:
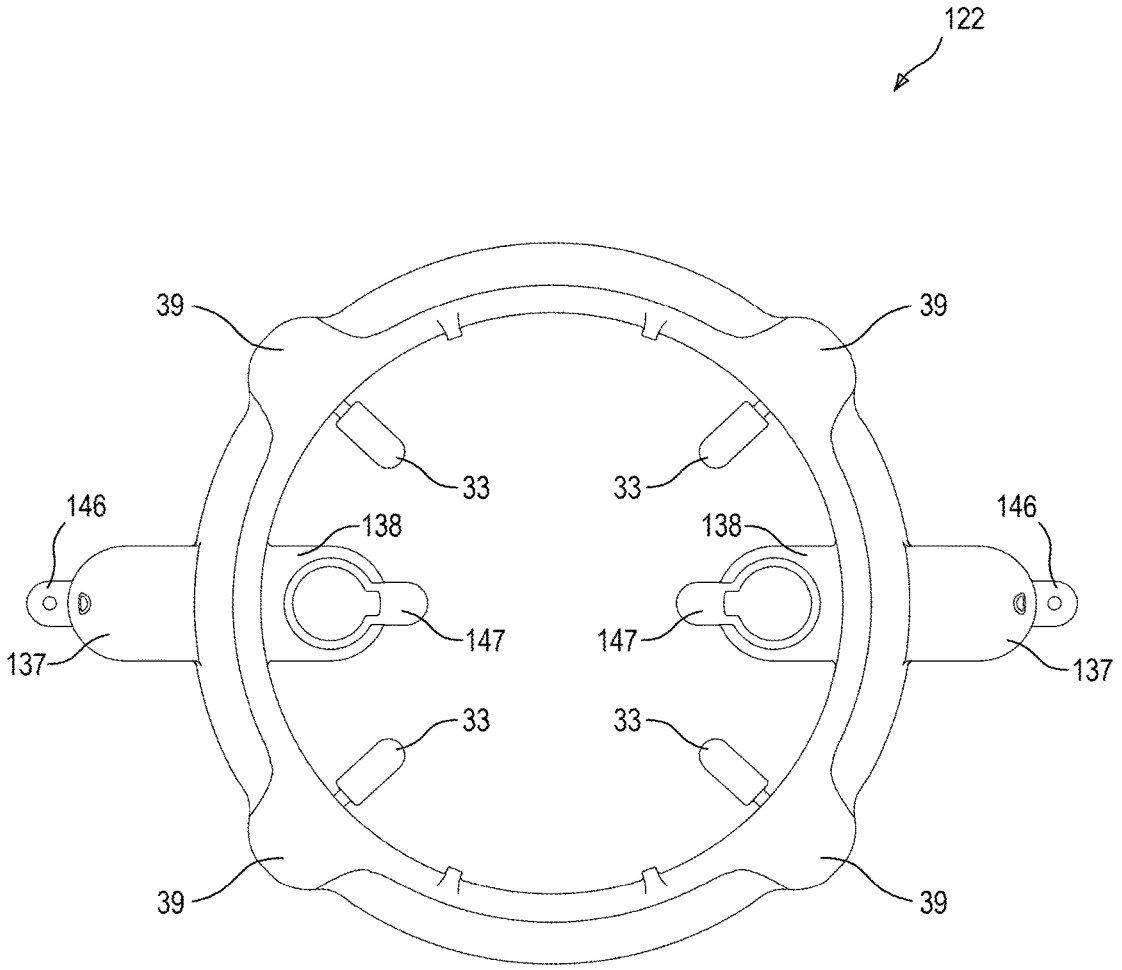
FIG. 51 is a front view of the base of FIG. 45.
Figure 52:
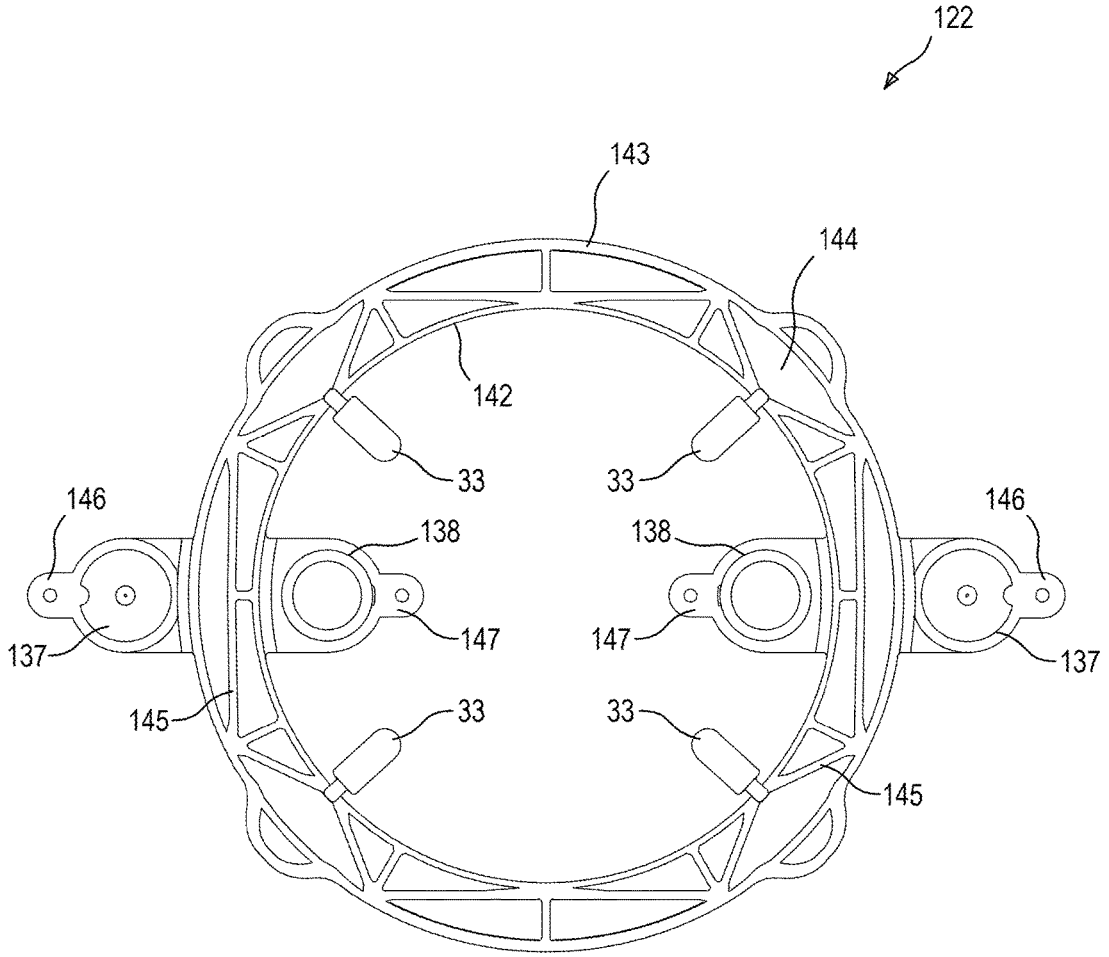
FIG. 52 is a rear view of the base of FIG. 45.

Referring generally to FIGS. 45-52, the base 122 is a generally circular member having an inner circumferential wall 142 and an outer circumferential wall 143, joined at a front side of the base 122. At a rear side of the base 122, as shown in FIGS. 46 and 52, for example, the base 122 includes a generally annular channel 144 formed between the inner circumferential wall 142 and outer circumferential wall 143.

A plurality of support structures 145 extend across the annular channel 144. The support structures 145 may be formed as walls or plates. The walls or plates may be configured to resemble a truss-like arrangement, by forming a plurality of substantially triangular zones within the annular channel 144. The support structures 145 may include radial support structures extending radially from the inner circumferential wall 142 to the outer circumferential wall 143. The support structures 145 may also include connecting support structures extending from the inner circumferential wall 142 at a radial support structure to the outer circumferential wall 143 at an adjacent radial support structure. Other support structures may extend from and to points along the outer circumferential wall 143. The support structures 145 advantageously increase the strength and durability of the base 122.

The base also includes receptacles 136 positioned diametrically opposite from one another. The receptacles 136 are disposed generally at a rear facing side of the base 122. Each receptacle includes a receptacle base 137 and a lid 138. Each receptacle base 137 is secured to the outer circumferential wall 143 and each lid 138 is secured to the inner circumferential wall 142. Each receptacle base 137 and lid 138 may be secured to a respective circumferential wall by a living hinge, for example. Accordingly, as described further below, each receptacle base 137 and lid 138 may rotated rearward relative the base 122, such that each receptacle base 137 is moved into frictional engagement a respective lid 138, or vice versa, to form the receptacles 136.

In addition, each receptacle base 137 includes a base fastening tab 146 and each lid 138 includes a lid fastening tab 147. The fastening tabs 146, 147 may each include openings that are aligned to receive a fastener when the base 137 and lid 138 are moved into engagement. The fastener may be any known suitable fastener, for example, a screw, bolt or pin. Accordingly, the receptacles 136 may be securely maintained against inadvertent or accidental opening, for example, during repeated use of the target assembly.

Referring to FIGS. 53-60, the spinner 123 of the embodiment described above associated with FIGS. 37-44, and the base 122 of the embodiment described above associated with FIGS. 45-52 may be assembled together to form the target assembly 121.

Figure 53:
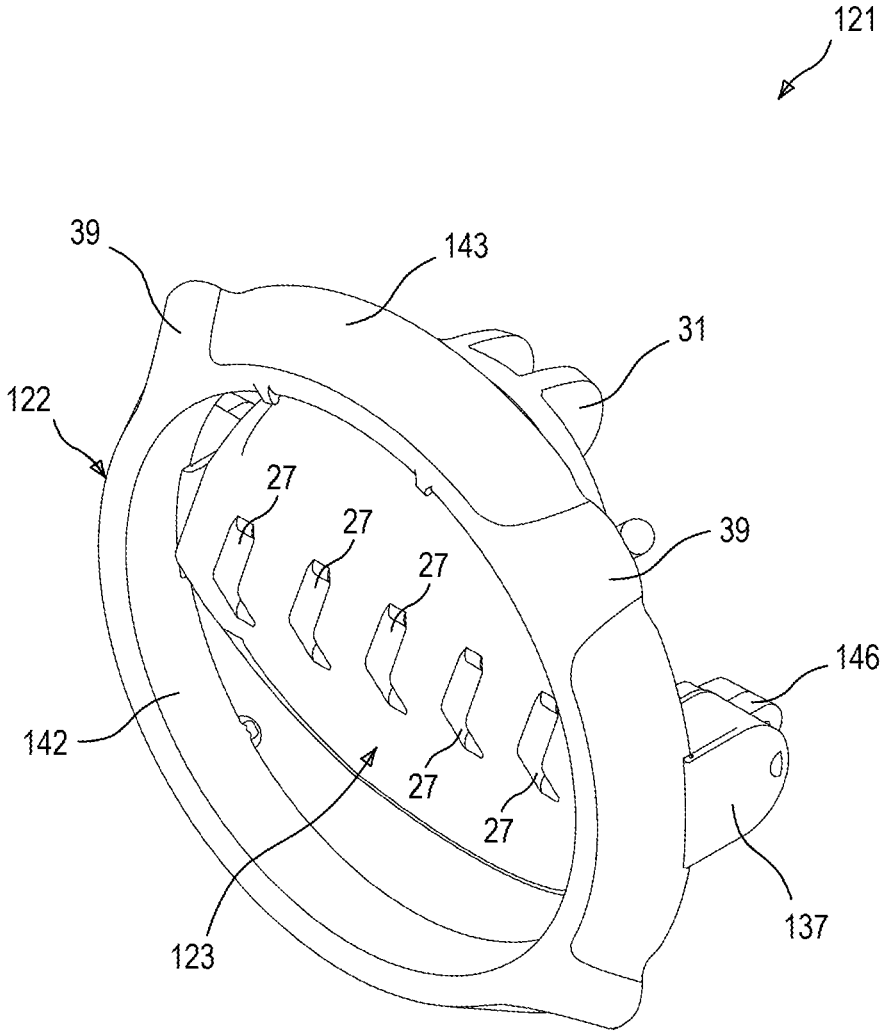
FIG. 53 is a front perspective view of a target assembly including the spinner of FIG. 37 and the base of FIG. 45.
Figure 54:
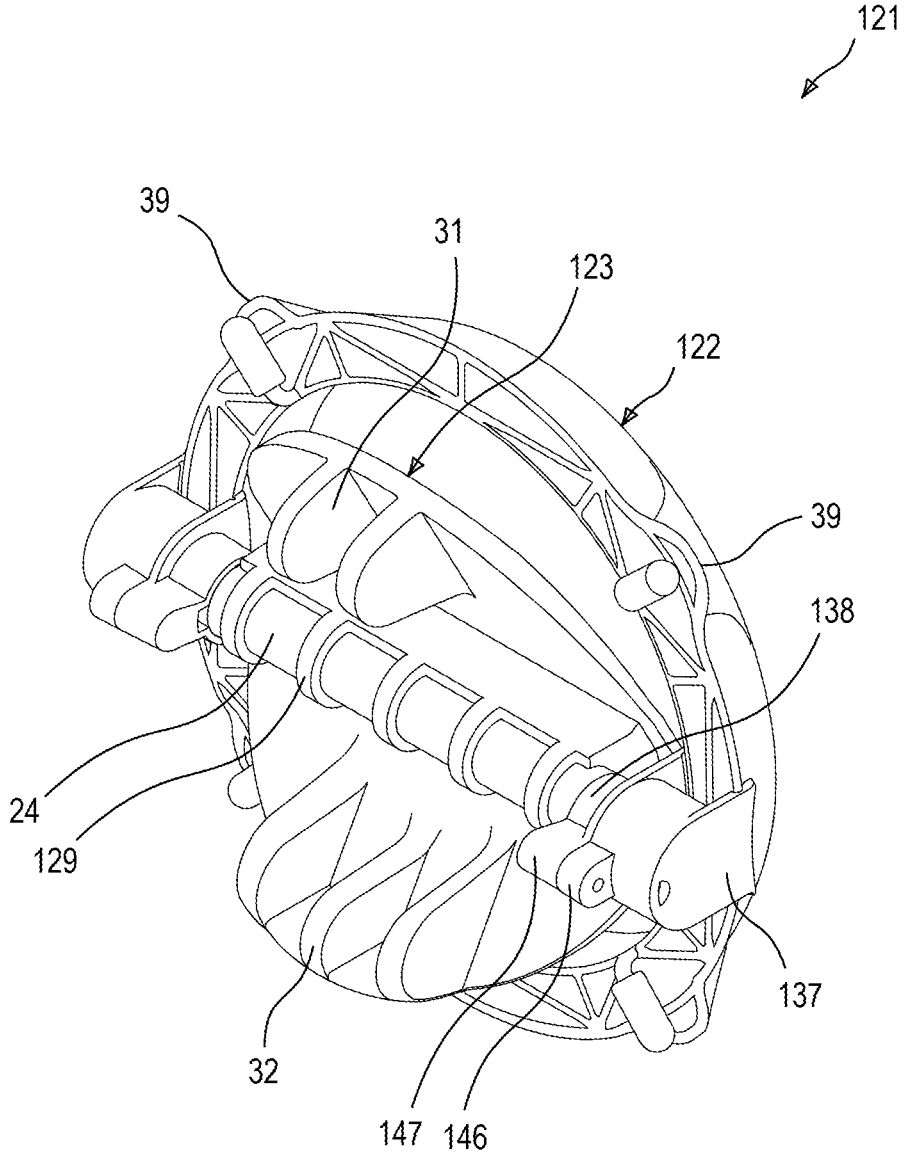
FIG. 54 is a rear perspective view of the target assembly of FIG. 53.
Figure 55:
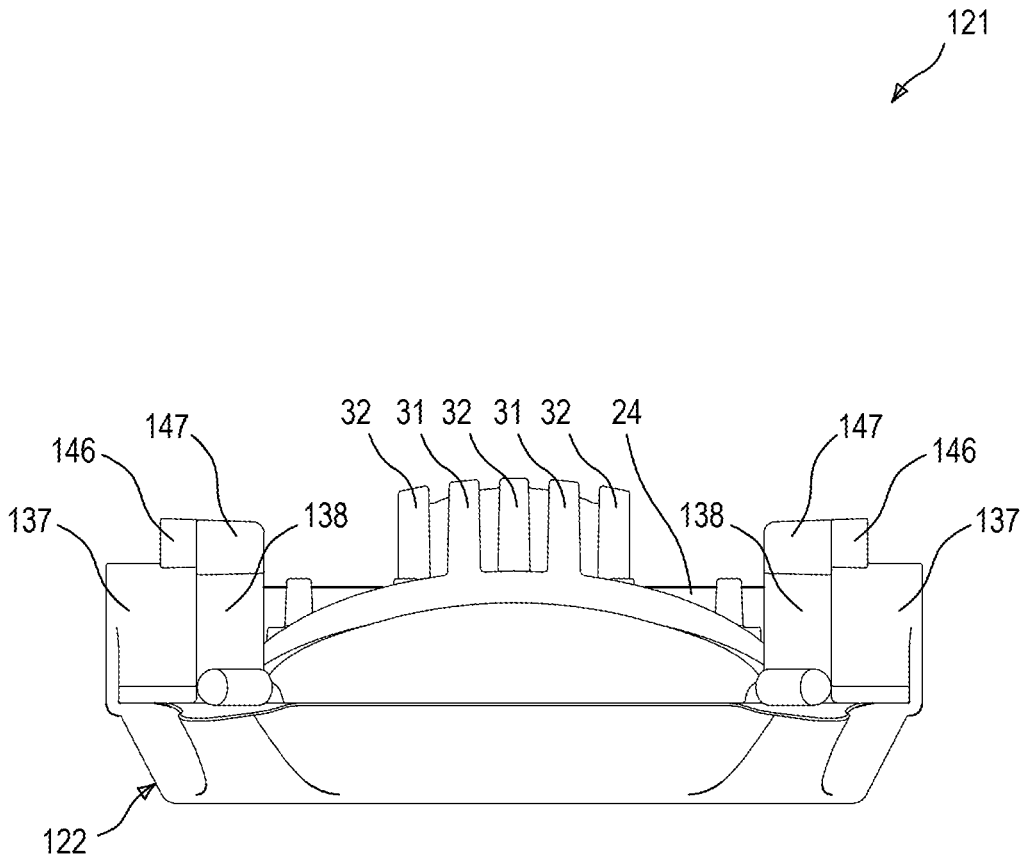
FIG. 55 is a top view of the target assembly of FIG. 53.
Figure 56:
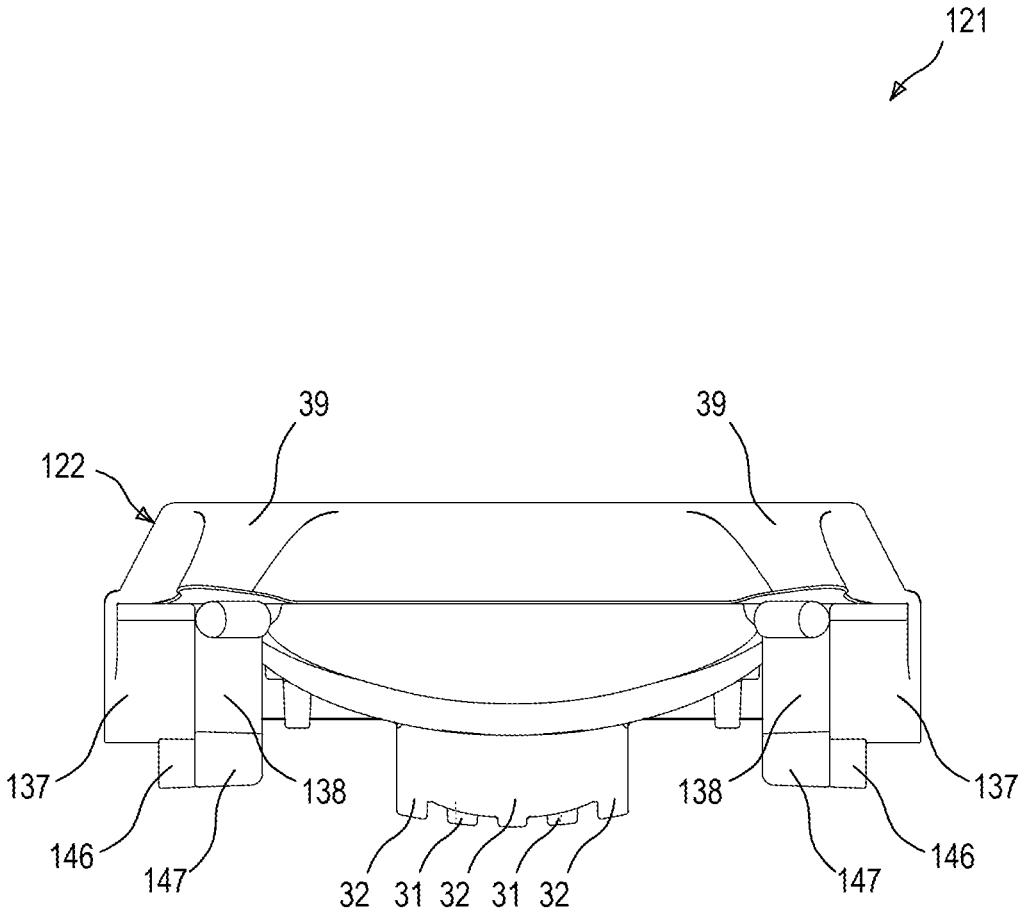
FIG. 56 is a bottom view of the target assembly of FIG. 53.
Figure 57:
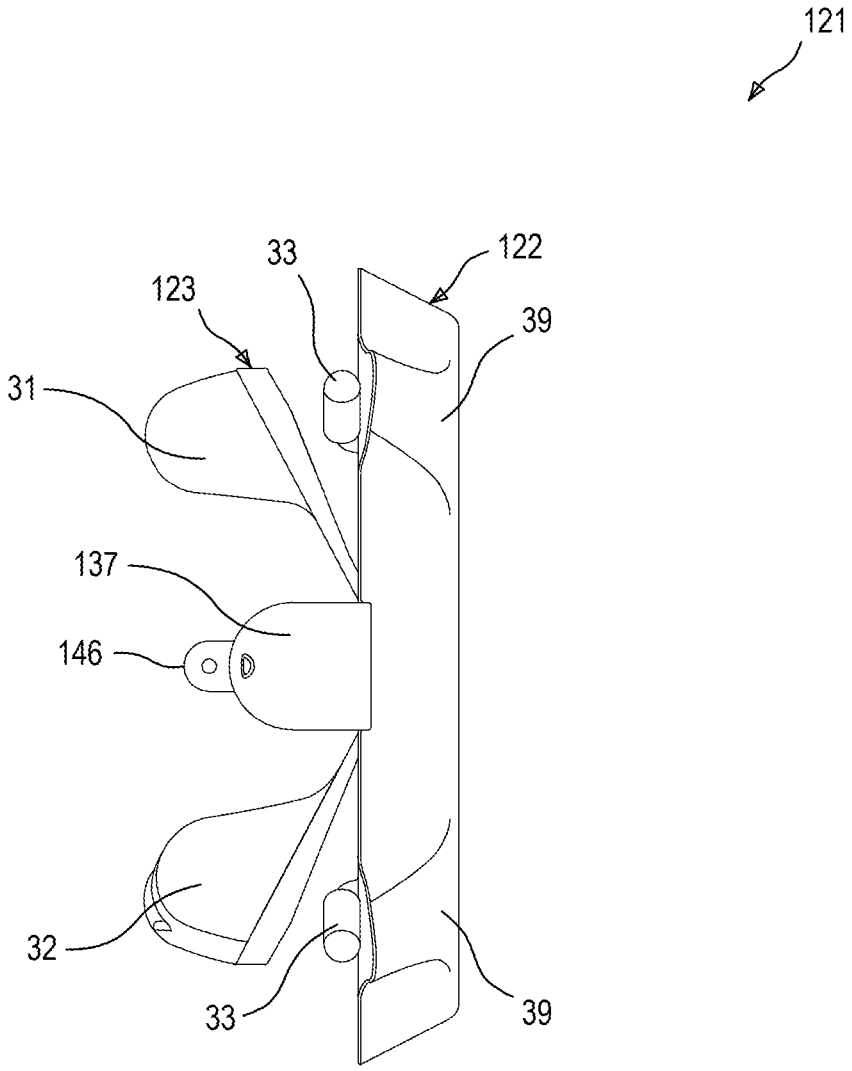
FIG. 57 is a left side view of the target assembly of FIG. 53.
Figure 58:
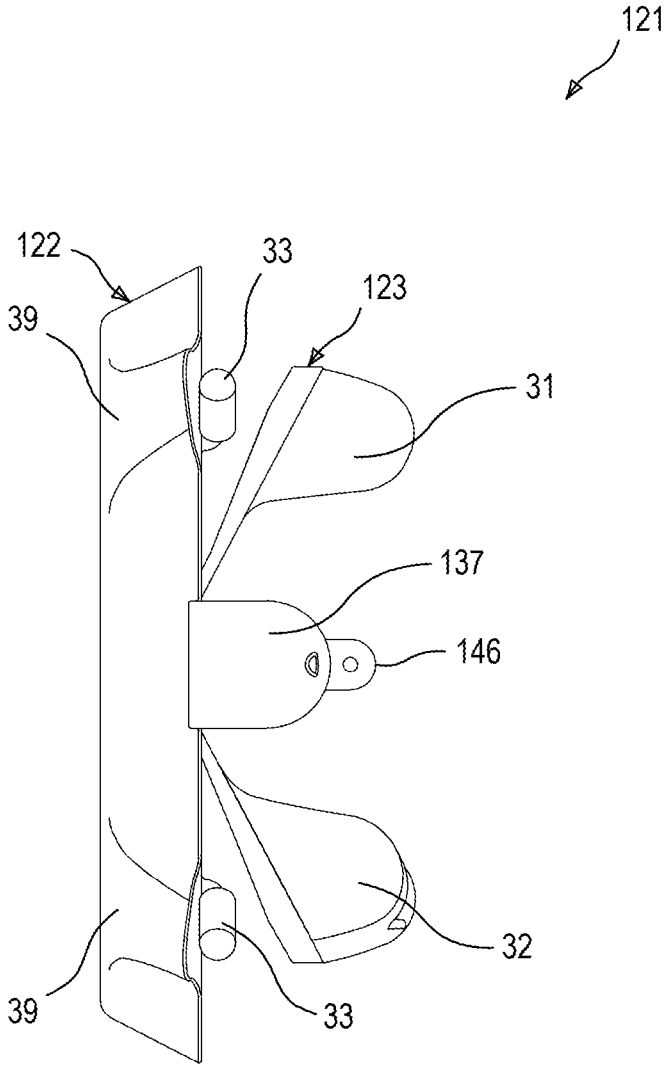
FIG. 58 is a right side view of the target assembly of FIG. 53.
Figure 59:
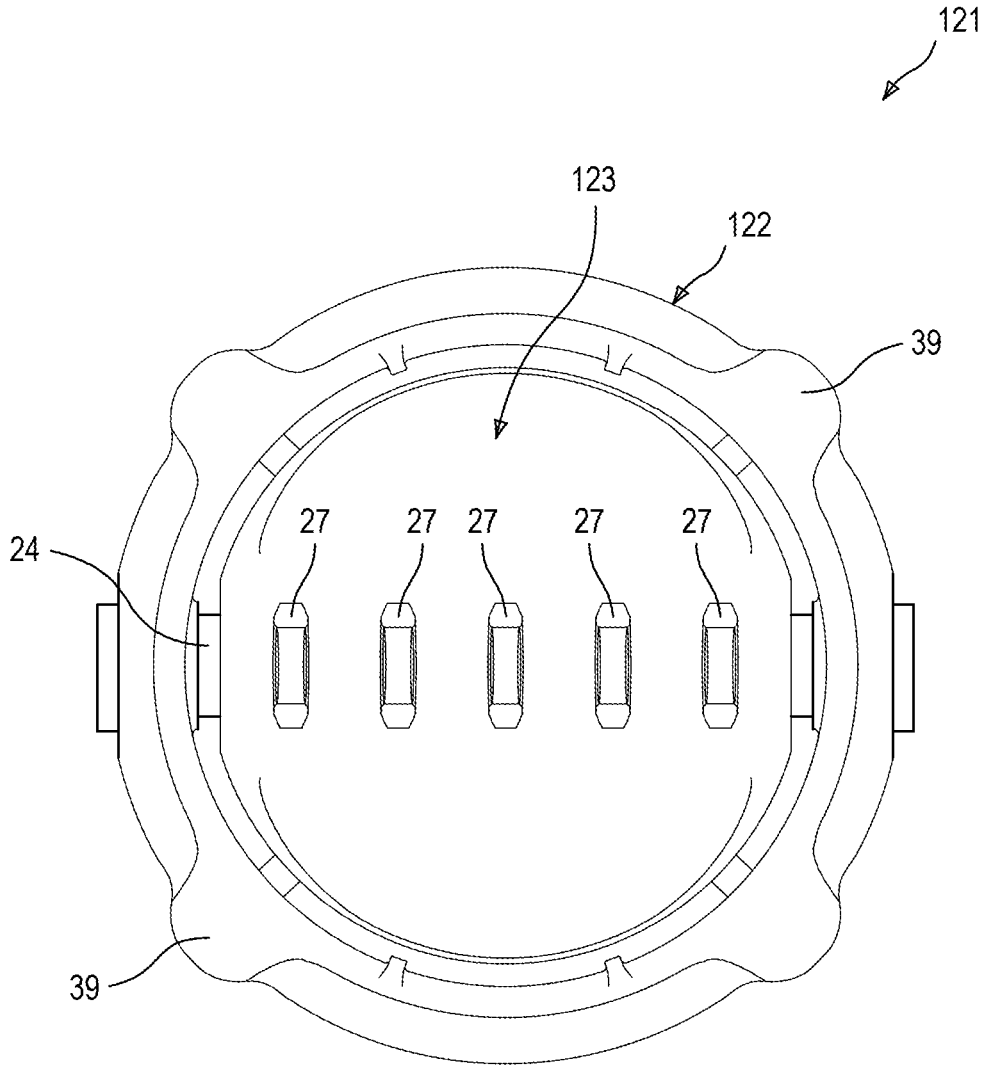
FIG. 59 is a front view of the target assembly of FIG. 53.
Figure 60:
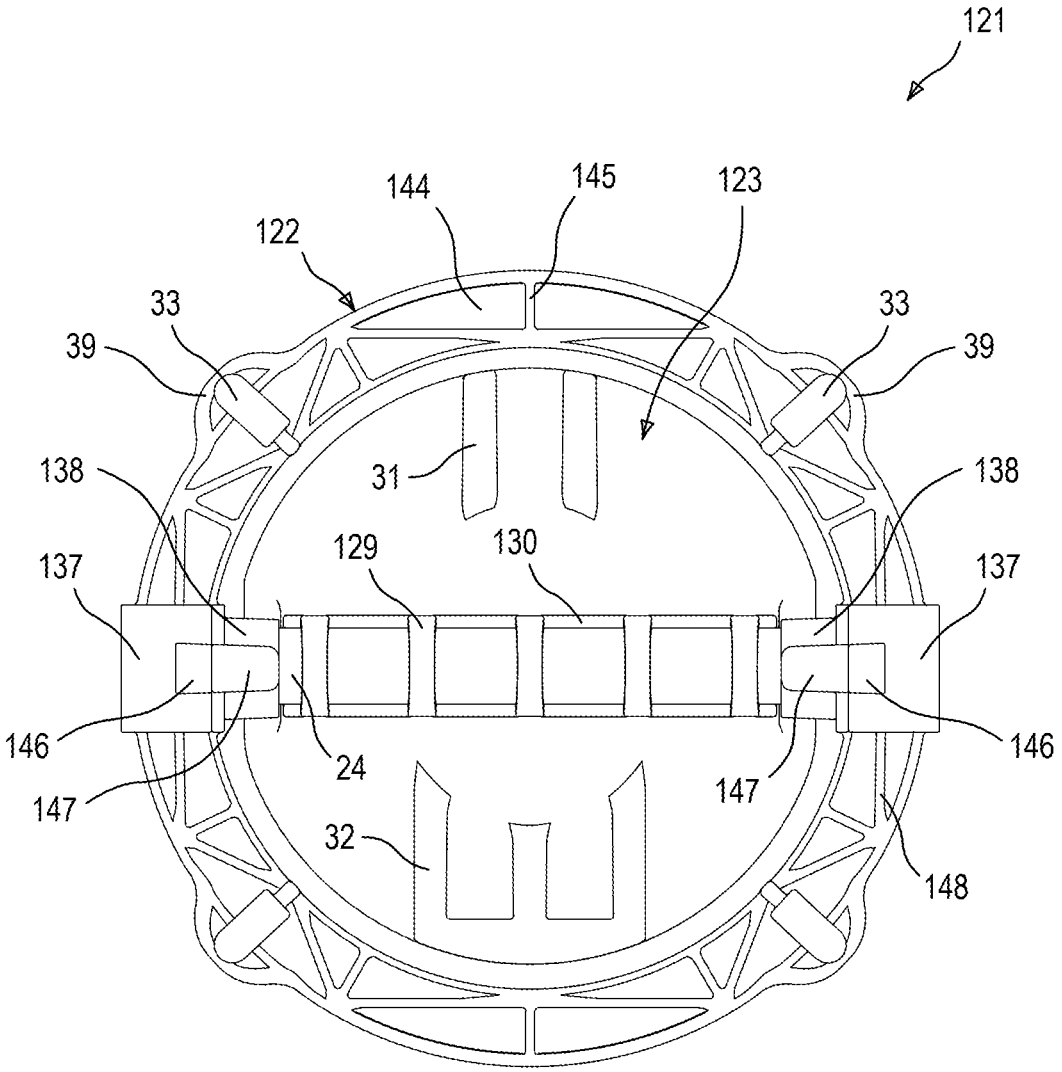
FIG. 60 is a rear view of the target assembly of FIG. 53.

As shown in FIGS. 53 and 54, for example, the bases 137 and lids 138 may be rotated or folded rearwardly into engagement with one another so as to from the receptacles 136 to hold the axle 24. With further reference to FIG. 54, the axle 24 is received in and extends through the loops 129 and engages grooves 130.

It will be appreciated by those skilled in the art that the features described herein may be found in various combinations. For example the features disclosed in the embodiments associated with FIGS. 37-60 may be used together or integrated with, individually or as a combination of features, the embodiments associated with FIGS. 1-36, and vice versa. As a further example, certain features of one embodiment may be interchangeably used with features of another embodiment.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

All patents referred to herein, are hereby incorporated herein by reference, whether or not specifically done so within the text of this disclosure.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A target assembly comprising:

a base having an outer periphery and an inner periphery, the inner periphery defining an opening extending through the base, the base comprising a pair of oppositely positioned receptacles positioned on opposite sides of the opening; and a first target body rotatably mounted on an axle and removably mountable to the base, the first target body having a front face and a rear face; and a second target body removably mountable to the base, wherein the first target body and second target body are interchangeably mountable to the base to provide a first use condition and a second use condition, wherein in the first use condition, only the first target body of the first and second target bodies is mounted to the base, the axle is removably secured to the base in the pair of oppositely positioned receptacles and extends across the opening, and the first target body is rotatably mounted on the axle such that the first target body rotates on the axle within the inner periphery of the base in response to being struck by a projectile, and wherein in the second use condition, only the second target body of the first and second target bodies is mounted to the base, the second target body is friction fit against the inner periphery of the base and is configured to break in response to being struck by a projectile.

2. The target assembly of claim 1, wherein each receptacle of the oppositely positioned receptacles includes a receptacle base and a lid configured to move between a frictionally engaged condition and a disengaged condition with one another.

3. The target assembly of claim 2, wherein in the frictionally engaged condition, the receptacle is configured to secure the axle to the base, and in the disengaged condition, the receptacle is configured to release the axle from the base.

4. The target assembly of claim 2, wherein the receptacle base and the lid are each connected to the base with a living hinge.

5. The target assembly of claim 1, wherein the first target body includes one or more loops on the rear face, the one or more loops configured to receive the axle.

6. The target assembly of claim 1, wherein the first target body is bent along its diameter to form an upper portion and a lower portion with a peak therebetween.

7. The target assembly of claim 1, the first target body further comprising one or more apertures extending through the body from the front face to the rear face, wherein the axle is visible through the apertures.

8. The target assembly of claim 1, wherein the axle emits light.

9. The target assembly of claim 1, wherein the inner periphery defines a shape, and the first target body defines a body shape that is the same as the shape defined by the inner periphery.

10. The target assembly of claim 1, wherein the front face of the first target body is symmetric about an axis of rotation.

11. The target assembly of claim 1, wherein the rear face includes weighted projections extending rearwardly, the weighted projections configured to cause the first target body to return to a generally centered position after being struck by a projectile.

12. The target assembly of claim 11, wherein the weighted projections include upper projections and lower projections, and a number of upper projections is less than a number of lower projections.

* * * * *